United States Patent [19]

Sequeira, Jr. et al.

[11] 4,167,451

[45] Sep. 11, 1979

[54] N-METHYL-2-PYRROLIDONE REFINING UNIT CONTROL SYSTEM

[75] Inventors: Avilino Sequeira, Jr.; Frank L. Barger, both of Port Arthur, Tex.

[73] Assignee: Texaco Inc., White Plains, N.Y.

[21] Appl. No.: 952,895

[22] Filed: Oct. 19, 1978

[51] Int. Cl.[2] ..... C10G 21/00; C06G 7/58

[52] U.S. Cl. ..... 196/14.52; 364/497; 364/501; 422/62

[58] Field of Search ..... 196/14.52; 422/62; 23/230 A; 364/497, 501

[56] References Cited

U.S. PATENT DOCUMENTS

| | | | |
|---|---|---|---|
| 3,799,871 | 3/1974 | Sequeira et al. | 196/14.52 |
| 3,911,259 | 10/1975 | Huddleston et al. | 364/501 |
| 3,972,779 | 3/1976 | Harrison | 196/14.52 |
| 4,053,744 | 10/1977 | Woodle | 196/14.52 |

*Primary Examiner*—R. E. Serwin

*Attorney, Agent, or Firm*—Thomas H. Whaley; Carl G. Ries; Ronald G. Gillespie

[57] ABSTRACT

A system controls a refining unit in which the refining unit includes an extractor receiving N-methyl-2-pyrrolidone solvent, hereafter referred to as MP, and charge oil, one of which is at a predetermined flow rate while the other flow rate is to be controlled and providing raffinate and extract mix. The control system includes sensors sensing the flow rate, the gravity, the viscosity, the refractive index and the sulfur content of the charge oil. Other sensors sense the flow rate of the MP and the temperature of the extract mix. The signals from the sensors are provided to control apparatus which controls the other flow rate of the charge oil and the MP flow rates in accordance with the signals from the sensors.

14 Claims, 23 Drawing Figures

VIDWCO COMPUTER 93
E6
API
RI
S
C55
C58
C57
C59
C56
C54
325
330
333
337
340
344
346
350
354
358
360
365
E17

J COMPUTER 88
E12
E11
KV210
T
S
E6
C53
C48
C49
C51
C50
C52
C47
290
291
292
293
294
295
300
301
302
303
305
309
310
E15

N-METHYL-2-PYRROLIDONE REFINING UNIT CONTROL SYSTEM

BACKGROUND OF THE INVENTION

The present invention relates to control systems in general and, more particularly, to control systems for oil refining units.

SUMMARY OF THE INVENTION

A refining unit treats charge oil with N-methyl-2-pyrrolidone solvent, hereafter referred to as MP, in an extractor which provides raffinate and extract mix. The raffinate is subsequently processed to yield refined oil. The MP is recovered from the raffinate and from the extract mix and returned to the extractor. A system controlling the refining unit includes a gravity analyzer, viscosity analyzers, a refractometer and a sulfur analyzer. The analyzers analyze the charge oil and provide corresponding signals. Flow rate sensors sense the flow rates of the charge oil and the MP entering the extractor and provide flow rate signals. One of the flow rates of the charge oil and the MP flow rate is a constant flow rate while the other flow rate is controllable. The controllable flow rate is controlled in accordance with the signals provided by the refractometer, all the sensors and the analyzers.

The objects and advantages of the invention will appear more fully hereinafter from a consideration of the detailed description which follows, taken together with the accompanying drawings wherein one embodiment of the invention is illustrated by way of example. It is to be expressly understood, however, that the drawings are for illustrative purposes only and are not to be construed as defining the limits of the invention.

DESCRIPTION OF THE INVENTION

Figure 1:
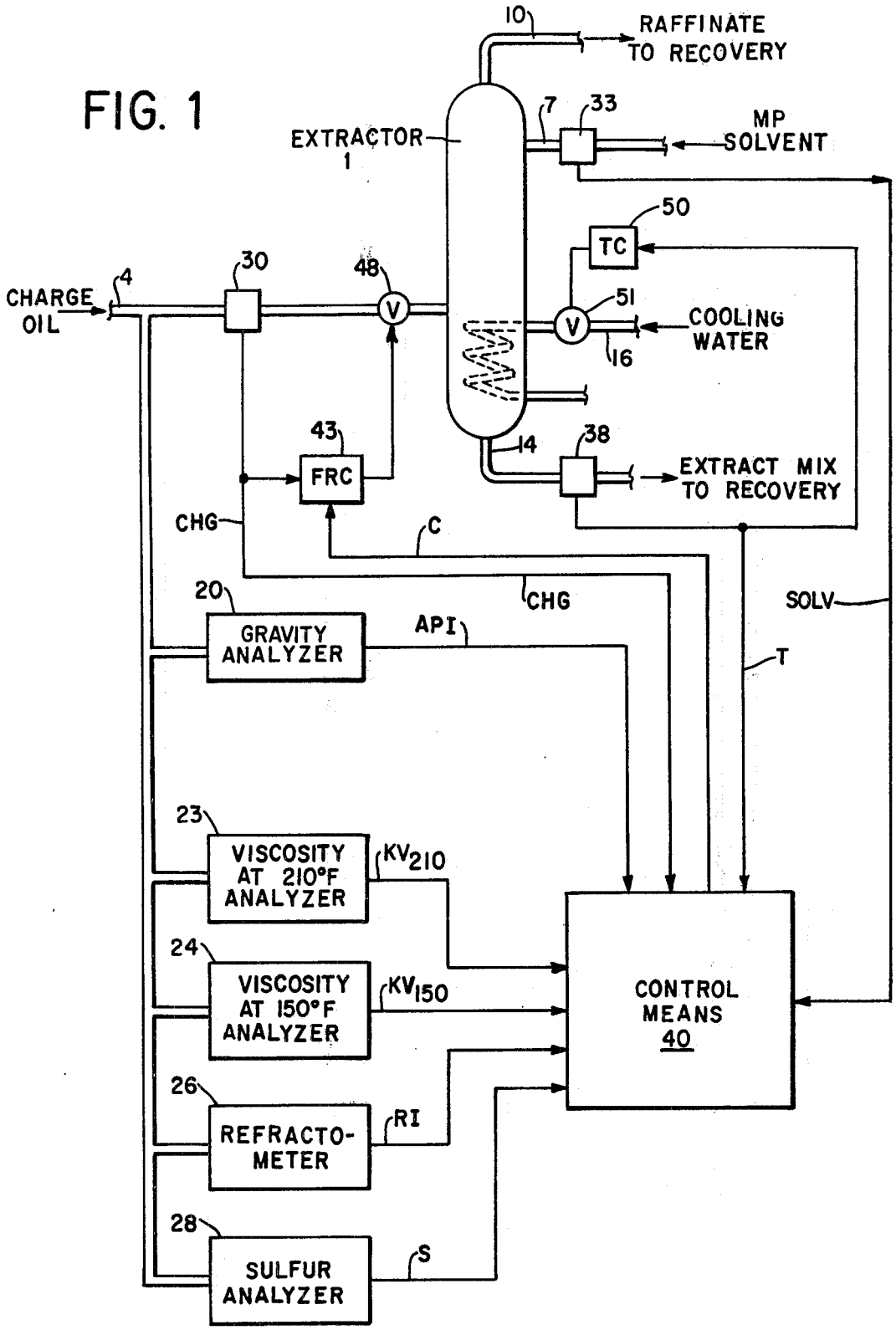
FIG. 1 is a simplified block diagram of a control system, constructed in accordance with the present invention, for controlling an oil refining unit shown in partial schematic form.

An extractor 1 in a refining unit receiving charge oil by way of a line 4 and N-methyl-2-pyrrolidone solvent, hereafter referred to as MP, by way of a line 7 and providing raffinate to recovery by way of a line 10, and an extract mix to recovery by way of a line 14. The raffinate is subsequently processed to yield refined oil. The temperature in extractor 1 is controlled by cooling water passing through a line 16. A gravity analyzer 20 viscosity analyzers 23 and 24, a refractometer 26 and a sulfur analyzer 28, sample the charge oil in line 4 and provide signals API, $KV_{210}$, $KV_{150}$, RI and S, respectively, corresponding to the API gravity, the flash point, the kinematic viscosity at 210° F., and the kinematic viscosity at 150° F., the refractive index and the sulfur content, respectively, of the charge oil.

A flow transmitter 30 in line 4 provides a signal CHG corresponding to the flow rate of the charge oil in line 4. Another flow transmitter 33 in line 7 provides a signal SOLV corresponding to the MP flow rate. A temperature sensor 38, sensing the temperature of the extract mix leaving extractor 1, provides a signal T corresponding to the sensed temperature. All signals hereinbefore mentioned are provided to control means 40.

Control means 40 provides signal C to a flow recorder controller 43. Recorder controller 43 receives signals CHG and C and provides a signal to a valve 48 to control the flow rate of the charge oil in line 4 in accordance with signals CHG and C so that the charge oil assumes a desired flow rate. Signal T is also provided to temperature controller 50. Temperature controller 50 provides a signal to a valve 51 to control the amount of cooling water entering extractor 1 and hence the temperature of the extract-mix in accordance with its set point position and signal T.

The following equations are used in practicing the present invention for light sweet charge oil, that is a charge oil having a sulfur content equal to or less than a predetermined sulfur content and having kinematic viscosity, corrected to a predetermined temperature, equal to or less than a first predetermined kinematic viscosity:

$$H_{210}=lnln(KV_{210}+C_1) \quad 1.$$

where $H_{210}$ is a viscosity H value for 210° F., $KV_{210}$ is the kinematic viscosity of the charge oil at 210° F. and $C_1$ is a constant having a preferred value of 0.6.

$$H_{150}=lnln(KV_{150}+C_1) \quad 2.$$

where $H_{150}$ is a viscosity H value for 150° F., and $KV_{150}$ is the kinematic viscosity of the charge oil at 150° F.

$$K_{150}=[C_2-ln(T_{150}+C_3)]/C_4, \quad 3.$$

where $K_{150}$ is a constant needed for estimation of the kinematic viscosity at 100° F., $T_{150}$ is 150, and $C_2$ through $C_4$ are constants having preferred values of 6.5073, 460 and 0.17937, respectively.

$$H_{100}=H_{210}+(H_{150}-H_{210})/K_{150}, \quad 4.$$

where $H_{100}$ is a viscosity H value for 100° F.

$$KV_{100}=\exp[\exp(H_{100})]-C_1, \quad 5.$$

where $KV_{100}$ is the kinematic viscosity of the charge oil at 100° F.

$$SUS=C_5(KV_{210})+[C_6+C_7(KV_{210})]/[C_8+C_9(KV_{210})+C_{10}(KV_{210})^2+C_{11}(KV_{210})^3](C_{12}), \quad 6.$$

where SUS is a factor needed in equation 7 and $C_5$ through $C_{12}$ are constants having preferred values of 4.6324, 1.0, 0.03264, 3930.2, 262.7, 23.97, 1.646 and $10^{-5}$, respectively.

$$SUS_{210}=[C_{13}+C_{14}(C_{15}-C_{16})]SUS, \quad 7.$$

where $SUS_{210}$ is the viscosity in Saybolt Universal Seconds at 210° F. and $C_{13}$ through $C_{16}$ are constants having preferred values of 1.0, 0.000061, 210 and 100, respectively.

$$VI_{DWCO}=-C_{17}-C_{18}(S)+C_{19}(KV_{210})^2+C_{20}(VI)^2+C_{21}(S)^2+C_{22}(API)(KV_{210})-C_{23}(KV_{210})(VI)+C_{24}(VI)(S), \quad 8.$$

where VI is the viscosity index of the light charge oil for 0° F. and $C_{17}$ through $C_{24}$ are constants having preferred values of 18.067, 51.155, 1.0108, 0.0084733, 2.2188, 1.0299, 0.34233 and 0.67215, respectively.

$$VI_{DWCp}=VI_{DWCO}+(\text{POUR})[C_{25}-C_{26}lnSUS_{210}+C_{27}(lnSUS_{210})^2], \quad 9.$$

where $VI_{DWCP}$ and Pour are the viscosity index of the dewaxed product at a predetermined temperature and the pour point of the dewaxed product, respectively, and $C_{25}$ through $C_{27}$ are constants having preferred values of 2.856, 1.18 and 0.126, respectively.

$$\Delta VI=VI_{RO}-VI_{DWCO}=VI_{RP}-VI_{DWCP}, \quad 10.$$

where $VI_{RO}$ and $VI_{RP}$ are the viscosity indexes of the refined oil at 0° F., and at the predetermined temperature, respectively.

$$\Delta RI=[C_{28}+C_{29}(KV_{210})-C_{30}(S)^2+C_{31}(\Delta VI)(API)-C_{32}(API)^2+C_{33}(API)(KV_{210})+C_{34}(VI)^2-C_{35}(KV_{210})(VI)+C_{36}(VI)(S)+C_{37}(\Delta VI)(KV_{210})]C_{38}, \quad 11.$$

where ΔRI is the change in refractive indexes between the light charge oil and the raffinate and $C_{28}$ through $C_{38}$ are constants having preferred values of 99.848, 41.457, 32.735, 0.11641, 0.37573, 23635, 0.03488, 1.3274, 1.2068, 0.25432 and $10^{-4}$, respectively.

$$J=-C_{39}+C_{40}(\Delta RI)+C_{41}(S)^2-C_{42}(KV_{210})(T)+C_{43}(VI)-C_{44}(S)+C_{45}(\Delta RI)(\Delta VI)-C_{46}(\Delta VI)(T), \quad 12.$$

where J is the MP dosage for the light sweet charge oil and $C_{39}$ through $C_{46}$ having preferred values of 31.022, 12315, 558.75, 0.08962, 2.9954, 860.35, 496.1 and 0.062708, respectively.

$$C=(\text{SOLV})(100)/J \quad 13.$$

For light sour charge oil, that is a charge oil having a sulfur content greater than the predetermined sulfur content and having temperature corrected kinematic viscosity equal to or less than the first predetermined kinematic viscosity, equations 1 through 10 and 13 are used. However, equation 12 is replaced by the following equation 14.

$$J=C_{47}-C_{48}(\Delta VI)-C_{49}(KV_{210})^2-C_{50}(S)(T)+C_{51}(KV_{210})(T)-C_{52}(VI)+C_{53}(\Delta RI)(\Delta VI), \quad 14.$$

where J is the MP dosage for light sour charge oil and $C_{47}$ through $C_{53}$ are constants having preferred values of 1495.9, 28.791, 23.287, 2.8512, 0.6435, 3.7239 and 639.44, respectively.

For medium sweet charge oil, that is a charge oil having a sulfur content equal to or less than the predetermined sulfur content and having a temperature corrected kinematic viscosity greater than the first predetermined kinematic viscosity but equal to or less than a second predetermined kinematic viscosity, equations 1 through 7, 9, 10 and 13 are used, along with the following three equations:

$$VI_{DWCO}=C_{54}-C_{55}(VI)+C_{56}(S)^2-C_{57}(RI)(API)+C_{58}(API)(VI)-C_{59}(API)(S), \quad 15.$$

where $VI_{DWCO}$ is the viscosity index of the medium charge oil at 0° F. and $C_{54}$ through $C_{59}$ are constants having preferred values of 838.96, 11.504, 3.1748, 19.19, 0.42412 and 0.38322, respectively.

$$\Delta RI=[C_{60}-C_{61}(\Delta VI)-C_{62}(KV_{210})^2+C_{63}(VI)^2-C_{64}(KV_{210})(API)+C_{65}(\Delta VI)(KV_{210})+C_{66}(API)(S)-C_{67}(VI)(S)-C_{68}(\Delta VI)^2]C_{69}, \quad 16.$$

where ΔRI is the change in refractive index between the medium charge oil and the raffinate and $C_{60}$ through $C_{69}$ are constants having preferred values of 386.48, 14.544, 1.4528, 0.01232, 1.4923, 2.4913, 27.217, 8.3297, 0.056978, and $10^{-4}$, respectively.

$$J=C_{70}+C_{71}(\Delta RI)-C_{72}(T)+C_{73}(T)^2+C_{74}(S)(T)+C_{75}(KV_{210})(T)-C_{76}(VI)-C_{77}(S)-C_{78}(\Delta RI)(T)+C_{79}(\Delta RI)(\Delta VI), \quad 17.$$

where J is the MP dosage for the medium sweet charge oil and $C_{70}$ through $C_{79}$ are constants having preferred values of 271.97, 83944, 4.648, 0.026 549, 11.487, 0.32774, 4.6927, 3103.3, 610.25 and 759.81, respectively.

Medium sour charge oil is a charge oil having a sulfur content greater than the predetermined sulfur content and having a temperature corrected kinematic viscosity greater than the first predetermined kinematic viscosity but equal to or less than the second predetermined kinematic viscosity.

For medium sour charge oil, equations 1 through 7, 9, 10, 13, 15 and 16 are used along with the following equation:

$$J=C_{80}+C_{81}(\Delta RI)+C_{82}(S)^2-C_{83}(VI)^2+C_{84}(T)^2+C_{85}(S)(T)-C_{86}(KV_{210})(T)-C_{87}(S)-C_{88}(\Delta RI)(T)+C_{89}(\Delta RI)(\Delta VI), \quad 18.$$

where J is the MP dosage for the medium sour charge oil and $C_{80}$ through $C_{89}$ are constants having preferred values of 690.21, 51327, 115.13, 0.078784, 0.034373, 3.7926, 0.41528, 974.48, 404.34 and 218.61, respectively.

Heavy sweet charge oil is charge oil having a sulfur content equal to or less than the predetermined sulfur content and having a temperature corrected kinematic viscosity greater than the second predetermined kinematic viscosity.

For heavy sweet charge oil, equations 1 through 7, 9, 10 and 13 are used as well as the following equations:

$$VI_{DWCO}=C_{90}-C_{91}(RI)+C_{92}(API)^2-C_{93}(RI)(S)+C_{94}(KV_{210})(VI)+C_{95}(KV_{210})(S), \quad 19.$$

where $VI_{DWCO}$ is the viscosity index of the heavy charge oil at 0° F. and $C_{90}$ through $C_{95}$ are constants having preferred values of 600.63, 434.96, 0.14988, 6.9334, 0.01532 and 0.79708, respectively.

$$\Delta RI=[-C_{96}+C_{97}(API)^2-C_{98}(S)^2+C_{99}(\Delta VI)(KV_{210})+C_{100}(\Delta VI)(S)+C_{101}(KV_{210})(S)]C_{102}, \quad 20.$$

where ΔRI is the change in refractive index between the heavy charge oil and the raffinate and $C_{96}$ through $C_{102}$ are constants having preferred values of 436.46, 0.89521, 11.537, 0.26756, 0.96234, 3.007 and $10^{-4}$, respectively.

$$J=-C_{103}+C_{104}(\Delta VI)+C_{105}(T)^2-C_{106}(S)+C_{107}(-\Delta RI)(\Delta VI)-C_{108}(\Delta VI)(T), \quad 21.$$

where J is the MP dosage for the heavy sweet charge oil and $C_{103}$ through $C_{108}$ are constants having preferred values of 363.41, 37.702, 0.020911, 492.43, 543.2 and 0.27069, respectively.

Heavy sour charge oil is a charge oil having a sulfur content greater than the predetermined sulfur content and having a temperature corrected kinematic viscosity greater than the second predetermined kinematic viscosity.

For heavy sour charge oil, equations 1 through 7, 9, 10, 13, 19 and 20 and the following equation:

$$J=C_{109}-C_{110}(\Delta VI)+C_{111}(S)^2-C_{112}(VI)^2-C_{113}(S)(T)+C_{114}(KV_{210})(T)+C_{115}(KV_{210})+C_{116}(\Delta RI)(-T)+C_{117}(\Delta RI)(\Delta VI), \quad 22.$$

where J is the solvent dosage for heavy sour charge oil and $C_{109}$ through $C_{117}$ are constants having preferred values of 1.3254, 9.5485, 55.4, 0.05189, 2.3087, 0.042058, 15.767, 27.712 and 280.25, respectively.

Figure 2:
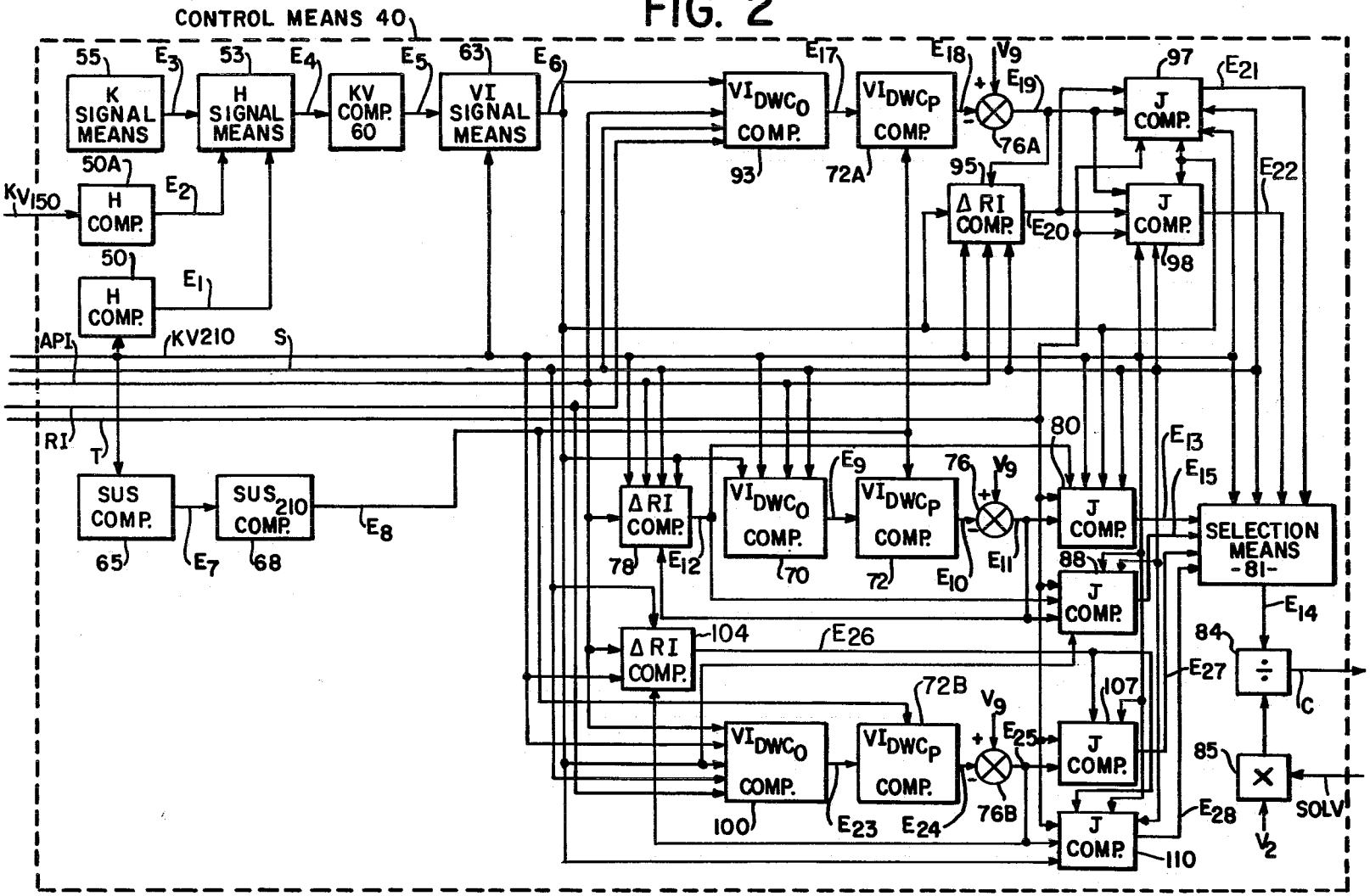
FIG. 2 is a simplified block diagram of the control means shown in FIG. 1.

Referring now to FIG. 2, signal $KV_{210}$ is provided to an H computer 50 in control means 40, while signal $KV_{150}$ is applied to an H computer 50A. It should be noted that elements having a number and a letter suffix are similar in construction and operation as to those elements having the same numeric designation without a suffix. All elements in FIG. 2, exceptbelements whose operation is obvious, will be disclosed in detail hereinafter. Computers 50 and 50A provide signals $E_1$ and $E_2$ corresponding to $H_{210}$ and $H_{150}$, respectively, in equations 1 and 2, respectively, to H signal means 53. K signal means 55 provides a signal $E_3$ corresponding to the term $K_{150}$ in equation 3 to H signal means 53. H signal means 53 provides a signal E4 corresponding to the term $H_{100}$ in equation 4 to the KV computer 60 which provides a signal $E_5$ corresponding to term $KV_{100}$ in accordance with signal $E_4$ and equation 5 as hereinafter explained.

Signals $E_5$ and $KV_{210}$ are applied to VI signal means 63 which provides a signal $E_6$ corresponding to the viscosity index.

An SUS computer 65 receives signal $KV_{210}$ and provides a signal $E_7$ corresponding to the term SUS in accordance with the received signals and equation 6 as hereinafter explained.

An SUS 210 computer 68 receives signal $E_7$ and supplies signal $E_8$ corresponding to the term $SUS_{210}$ in accordance with the received signal and equation 7 as hereinafter explained.

A $VI_{DWCO}$ computer 70 receives signal $KV_{210}$, API, S and $E_6$ and provides a signal $E_9$ corresponding to the term $VI_{DWCO}$ in accordance with the received signals and equation 8 as hereinafter explained.

A $VI_{DWCP}$ computer 72 receives signal $E_8$ and $E_9$ and provides a signal $E_{10}$ corresponding to the term $VI_{DWCP}$ in accordance with the received signals and equation 9. Subtracting means 76 performs the function of equation 10 by subtracting signal $E_{10}$ from voltage $V_9$ corresponding to the term $VI_{RP}$, in equation 10, to provide a signal $E_{11}$ corresponding to the term ΔVI in equation 10.

A ΔRI computer 78 receives signals API, $KV_{210}$, S, $E_{11}$ and $E_6$ and provides a signal $E_{12}$ corresponding to a term ΔRI, in accordance with the received signals and equation 11, as hereinafter explained.

A J computer 80 receives signals $KV_{210}$, S, T, $E_6$, $E_{11}$ and $E_{12}$ and provides a signal $E_{13}$ corresponding to the term J in accordance with the received signals and equation 12 as hereinafter explained.

It should be noted that the dosage J just previously described, is for light sweet charge oil. As the rest of the operation of control means 40 continues to be described it will be noted that there will be a J signal for each of the different types of charge oil, that is, light sweet charge oil, light sour charge oil, medium sweet charge oil, medium sour charge oil, heavy sweet charge oil and heavy sour charge oil. It will be appreciated that since there is no previous switching being done that each J computer will provide a J signal, so that there will be six J signals. However, only one of them is a correct and proper signal and that one signal being associated with the charge oil that is in line 4. Therefore, the J signals such as signal $E_{13}$, are applied to selection means 81, which will be described in greater detail hereinafter. Selection means 81 selects the proper J signal as determined in accordance with signal $KV_{210}$ and S and provides the selected J signal to a divider 84. A multiplier 85 multiplies signal SOLV with a direct current voltage $V_2$ corresponding to a value of 100 to provide a signal corresponding to the term (SOLV)(100) in equation 13. The signal from multiplier 85 is divided into the signal from selection means 81 to provide signal C.

Another J computer 88 provides a signal $E_{15}$ corresponding to the J factor in equation 14 for light sour charge oil. J computer 88 receives signals S, T, $KV_{210}$, $E_6$, $E_{11}$ and $E_{12}$ and provide signal $E_{15}$ in accordance with the received signal and equation 14.

Another $VI_{DWCO}$ computer 93 receives signals RI, S, API and $E_6$ and provides a signal $E_{17}$ corresponding to the term $VI_{DWCO}$ in equation 15 in accordance with the received signals and equation 15 as hereinafer explained. A $VI_{DWCP}$ computer 72A provides a signal $E_{18}$ corresponding to the term $VI_{DWCP}$ in equation 9, in accordance with signals $E_8$ and $E_{17}$ and equation 9. Subtracting means 76A subtracts signal $E_{18}$ from voltage $V_9$ to provide a signal $E_{19}$ corresponding to the term ΔVI in equation 10.

A ΔRI computer 95 receives signals $KV_{210}$, API, S, $E_6$ and $E_{19}$ and provides a signal $E_{20}$ corresponding to the term RI in equation 16, in accordance with the received signals and equation 16 as hereinafter explained. A J computer 97 receives signals $KV_{220}$, S, $E_6$, $E_{19}$ and $E_{20}$ and provides a signal $E_{21}$ corresponding to the J factor in equation 17 for medium sweet charge oil in accordance with the received signals and equation 17 as hereinafter explained. Signal $E_{21}$ is applied to selection means 81.

A J computer 97 receives signals $KV_{210}$, S, T, $E_6$, $E_{19}$ and $E_{20}$ and provides a signal $E_{21}$ corresponding to the J factor in equation 17 for medium sweet charge oil in accordance with the received signals and equation 17 as hereinafter explained.

Another J computer 98 receives signals $KV_{210}$, S, T, $E_6$, $E_{20}$ and $E_{19}$ and provides a signal $E_{22}$ corresponding to the J factor in equation 18 for medium sour charge oil in accordance with the received signals and equation 18 as hereinafter explained. Signal $E_{22}$ is supplied to selection means 81.

A $VI_{DWCO}$ computer 100 receives signals $KV_{210}$, API, S, RI and $E_6$ and provides a signal $E_{23}$ corresponding to the term $VI_{DWCO}$ in equation 19, in accordance with the received signals and equation 19 as hereinafter explained.

A $VI_{DWCP}$ computer 72B provides a signal $E_{24}$ corresponding to the term $VI_{DWCP}$ in equation 9 in accordance with the received signals $E_8$ and $E_{23}$ and equation 9. Subtracting means 76B subtracts signal $E_{24}$ from voltage $V_9$ to provide a signal $E_{25}$ corresponding to the term $\Delta VI$ in equation 10.

A $\Delta RI$ computer 104 receives signals $KV_{210}$, API, S and $E_{25}$ and provides a signal $E_{26}$, corresponding to the term $\Delta RI$ in equation 20, in accordance with the received signals and equation 20.

A J computer 107 receives signals S, T, $E_{25}$ and $E_{26}$ to provide a signal $E_{27}$ corresponding to the J term for heavy sweet charge oil in equation 21 in accordance with the received signals and equation 21. Since $E_{27}$ is applied to selection means 81.

A J computer 110 receives signals $KV_{210}$, S, T, $E_6$, $E_{25}$ and $E_{26}$ to provide a signal $E_{28}$ corresponding to the J factor for heavy sour charge oil in accordance with the received signals and equation 22, as hereinafter explained. Signal $E_{28}$ is provided to selection means 81.

Figure 3:
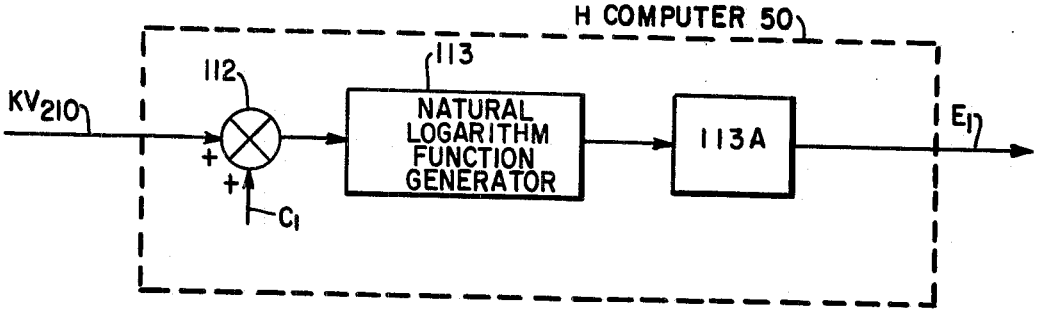
FIGS. 3 through 23 are simplified block diagrams of the H computer, the K signal means, the H signal means, the KV computer, the VI signal means, the SUS computer, the $SUS_{210}$ computer, the $VI_{DWCO}$ computer, the $VI_{DWCP}$ computer, the ΔRI computer, the J computer, the J computer, the $VI_{DWCO}$ computer, the ΔRI computer, the J computer, the J computer, the $VI_{DWCO}$ computer, the RI computer, the J computer, the J computer and the selection means, respectively, shown in FIG. 2.

Referring now to FIG. 3, H computer 50 includes summing means 112 receiving signal $KV_{210}$ and summing it with a direct current voltage $C_1$ to provide a signal corresponding to the term $[KV_{210}+C_1]$ shown in equation 1. The signal from summing means 112 is applied to a natural logarithm function generator 113 which provides a signal corresponding to the natural log of the sum signal which is then applied to another natural log function generator 113A which in turn provides signal $E_1$.

Figure 4:
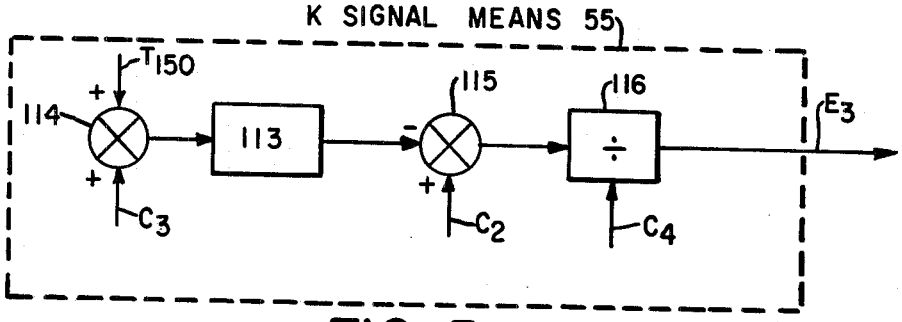

Referring now to FIG. 4, K signal means 55 includes summing means 114 summing direct current voltages $T_{150}$ and $C_3$ to provide a signal corresponding to the term $[T_{150}+C_3]$ which is provided to a natural log function generator 113B which in turn provides a signal corresponding to the natural log of the sum signal from summing means 114. Subtracting means 115 subtracts the signal provided by function generator 113B from a direct current voltage $C_2$ to provide a signal corresponding to the numerator of equation 3. A divider 116 divides the signal from subtracting means 115 with a direct current voltage $C_4$ to provide signal $E_3$.

Figure 5:
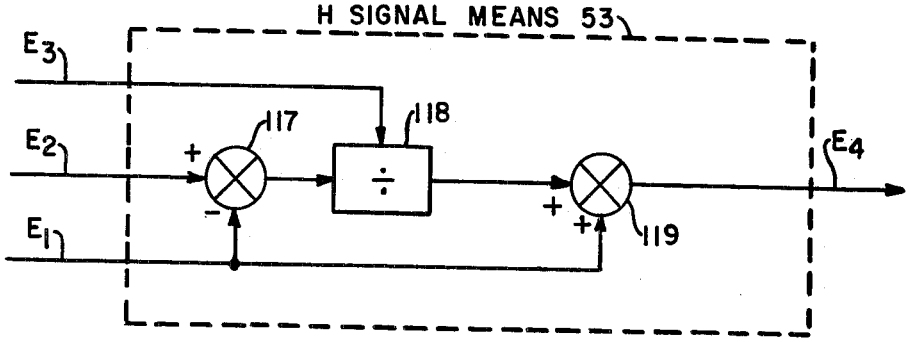

Referring now to FIG. 5, H signal means 53 includes subtracting means 117 which subtracts signal $E_1$ from signal $E_2$ to provide a signal corresponding to the term $H_{150}-H_{210}$, in equation 4, to a divider 118. Divider 118 divides the signal from subtracting means 117 by signal $E_3$. Divider 118 provides a signal which is summed with signal $E_1$ by summing means 119 to provide signal $E_4$ corresponding to $H_{100}$.

Figure 6:
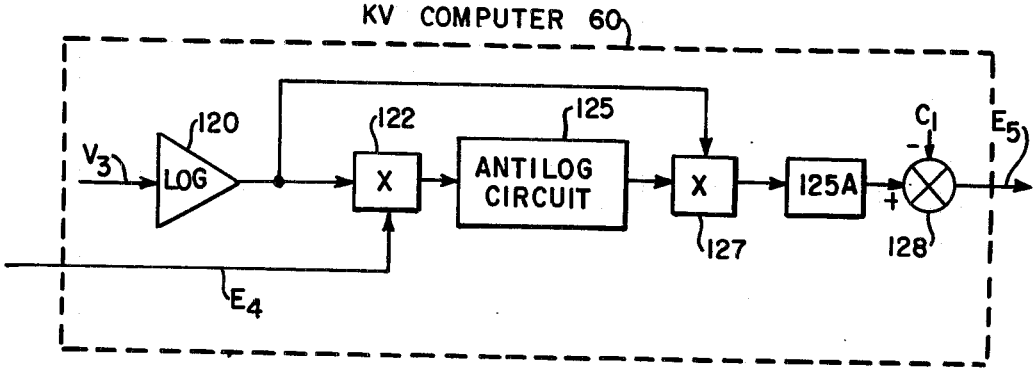

Referring now to FIG. 6, a direct current voltage $V_3$ is applied to a logarithmic amplifier 120 in KV computer 60. Direct current voltage $V_3$ corresponds to the mathematical constant e. The output from amplifier 120 is applied to a multiplier 122 where it is multiplied with signal $E_4$. The product signal from multiplier 122 is applied to an antilog circuit 125 which provides a signal corresponding to the term exp $[H_{100}]$ in equation 5. The signal from circuit 125 is multiplied with the output from logarithmic amplifier 120 by a multiplier 127 which provides a signal to antilog circuit 125A. Signal 125A is provided to subtracting means 128 which subtracts a direct current voltage $C_1$ from signal 125A to provide signal $E_5$.

Figure 7:
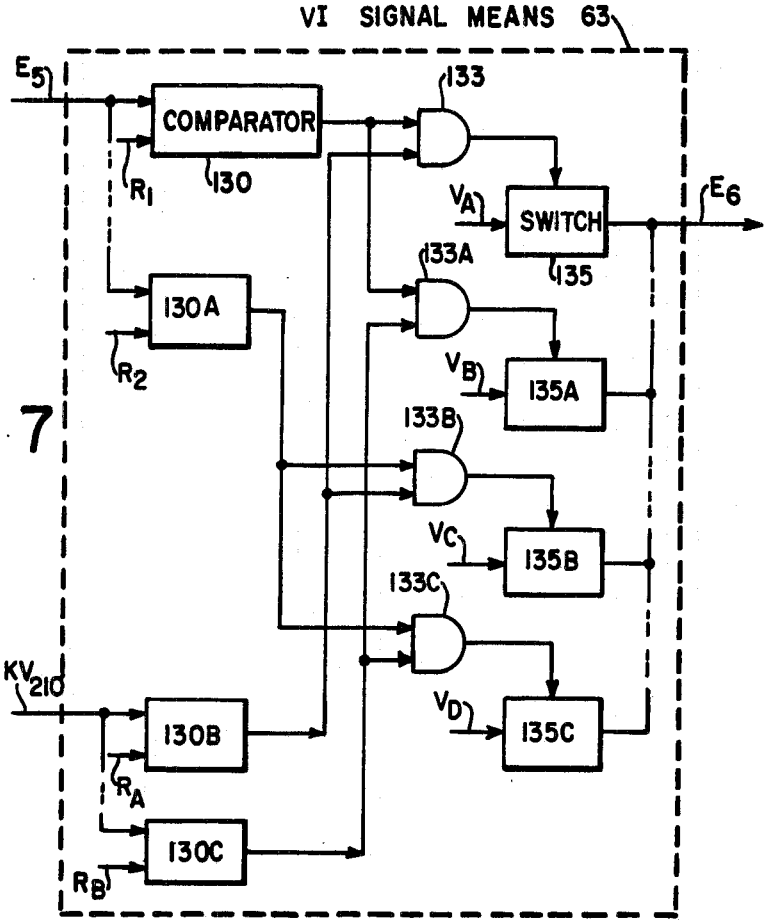

Referring now to FIG. 7, VI signal means 63 is essentially memory means which is addressed by signals $E_5$, corresponding to $KV_{100}$, and signal $KV_{210}$. In this regard, a comparator 130 and comparator 130A represent a plurality of comparators which receive signal $E_5$ and compare signal $E_5$ to reference voltages, represented by voltages $R_1$ and $R_2$, so as to decode signal $E_5$. Similarly, comparators 130B and 130C represent a plurality of comparators receiving signal $KV_{210}$ which compare signal $KV_{210}$ with reference voltages RA and RB so as to decode signal $KV_{210}$. The outputs from comparators 130 and 130B are applied to an AND gate 133 whose output controls a switch 135. Thus, should comparators 130 and 130B provide a high output, AND gate 133 is enabled and causes switch 135 to be rendered conductive to pass a direct current voltage $V_A$, corresponding to a predetermined value, as signal $E_6$ which corresponds to VI. Similarly, the outputs of comparators 130 and 130C control an AND gate 133A which in turn controls a switch 135A to pass or to block a direct current voltage $V_B$. Similarly, another AND gate 133B is controlled by the outputs from comparators 130A and 130B to control a switch 135B so as to pass or block a direct current voltage $V_C$. Again, an AND gate 133C is controlled by the outputs from comparators 130A and 130C to control a switch 135C to pass or to block a direct current voltage $V_D$. The outputs of switches 135 through 135C are tied together so as to provide a common output.

Figure 8:
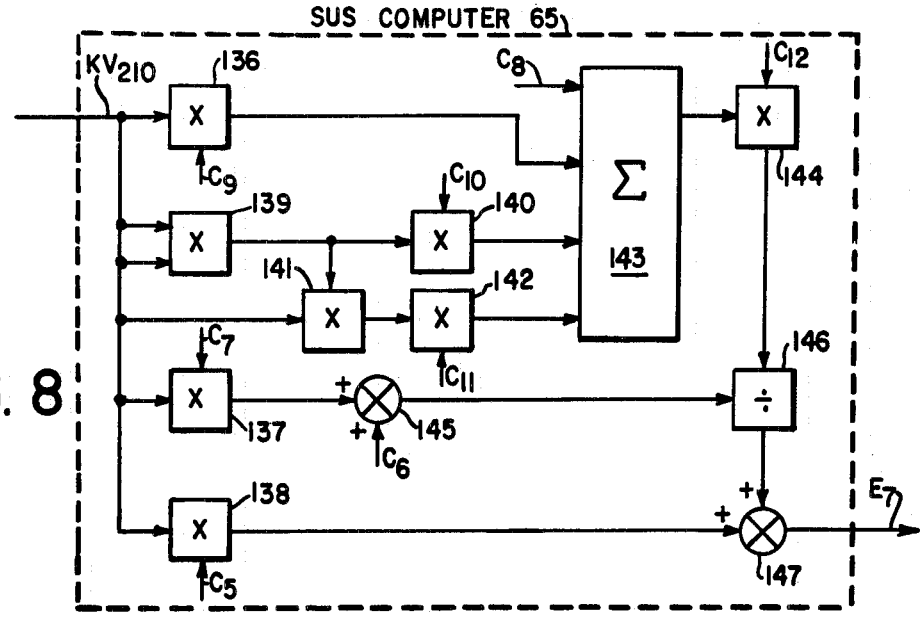

Referring now to FIG. 8, the SUS computer 65 includes multipliers 136, 137 and 138 multiplying signal $KV_{210}$ with direct current voltages $C_9$, $C_7$ and $C_5$, respectively, to provide signals corresponding to the terms $C_9(KV_{210})$, $C_7(KV_{210})$ and $C_5(KV_{210})$, respectively in equation 6. A multiplier 139 effectively squares signal $KV_{210}$ to provide a signal to multipliers 140, 141. Multiplier 140 multiplies the signal from multiplier 139 with a direct current voltage $C_{10}$ to provide a signal corresponding to the term $C_{10}(KV_{210})^2$ in equation 6. Multiplier 141 multiplies the signal from multiplier 139 with signal $KV_{210}$ to provide a signal corresponding to $(KV_{210})^3$. A multiplier 142 multiplies the signal from multiplier 141 with a direct current voltage $C_{11}$ to provide a signal corresponding to the term $C_{11}(KV_{210})^3$ in equation 6. Summing means 143 sums the signals from multipliers 136, 140 and 142 with a direct current voltage $C_8$ to provide a signal to a multiplier 144 where it is multiplied with a direct current voltage $C_{12}$. The signal from multiplier 137 is summed with a direct current voltage $C_6$ by summing means 145 to provide a signal corresponding to the term $[C_6+C_7(KV_{210})]$. A divider 146 divides the signal provided by summing means 145 with the signal provided by multiplier 144 to provide a signal which is summed with the signal from multiplier 138 by summing means 147 to provide signal $E_7$.

Figure 9:
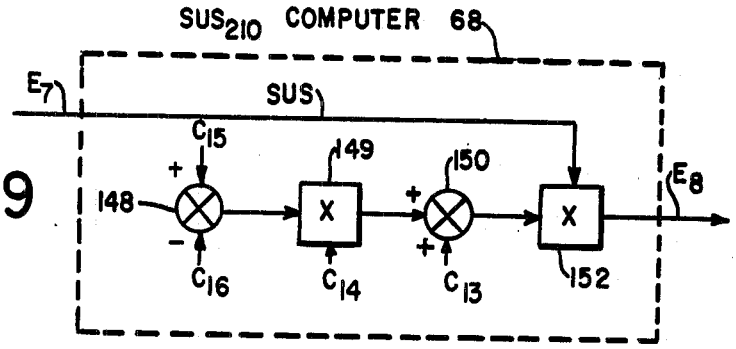

Referring now to FIG. 9, $SUS_{210}$ computer 68 includes subtracting means 148 which subtracts a direct current voltage $C_{16}$ from another direct current voltage $C_{15}$ to provide a signal corresponding to the term $(C_{15}-C_{16})$ in equation 7. The signal from subtracting means 148 is multiplied with a direct current voltage $C_{14}$ by a multiplier 149 to provide a product signal which is summed with another direct current voltage $C_{13}$ by summing means 150. Summing means 150 provides a signal corresponding to the term $[C_{13}+C_{14}(C_{15}-C_{16})]$ in equation 7. The signal from summing means 150 is multiplied with signal $E_7$ by a multiplier 152 to provide signal $E_8$.

Figure 10:
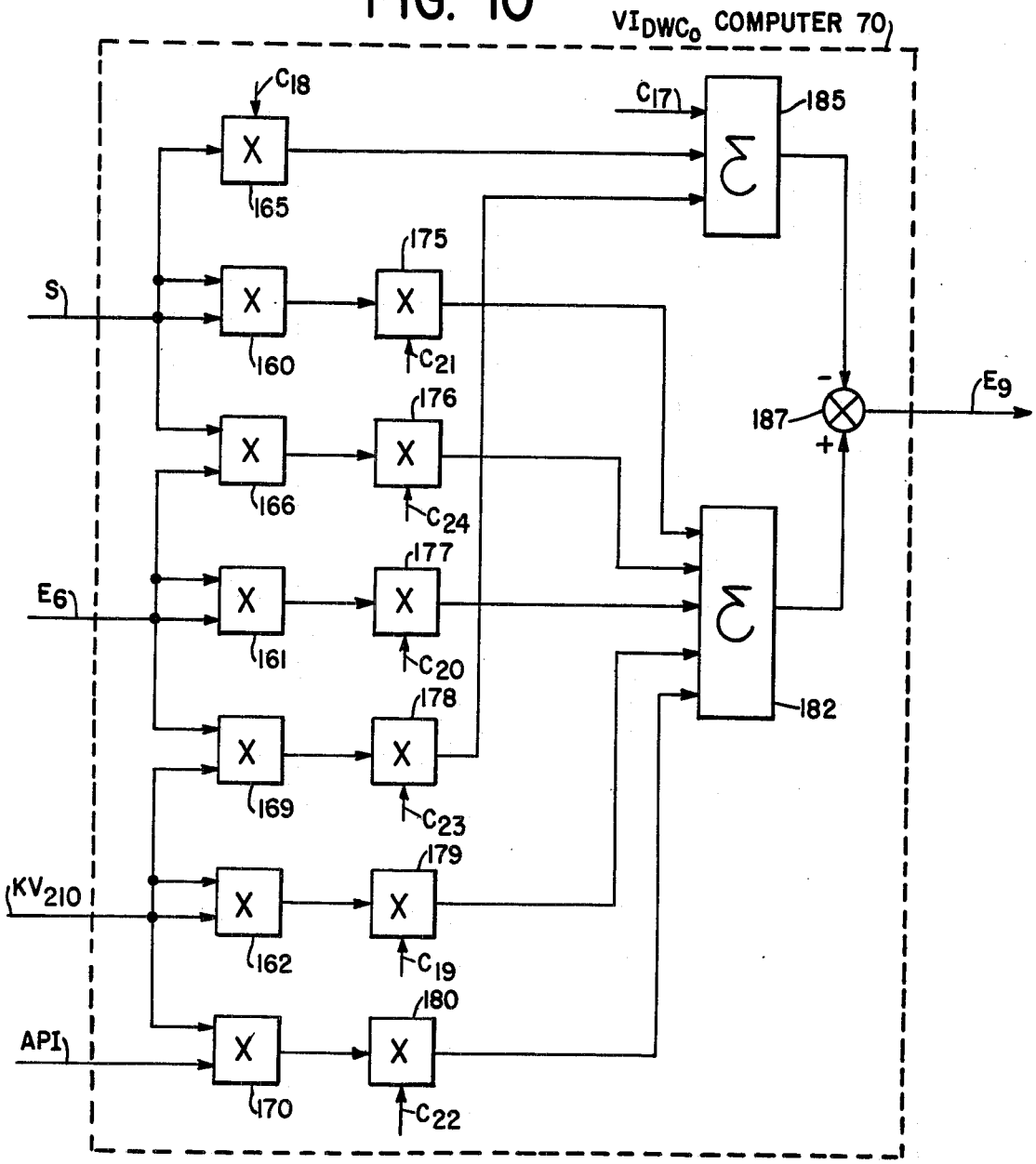

Referring now to FIG. 10, $VI_{DWCO}$ computer 70 includes multipliers 160, 161 and 162 which effectively square signals S, $E_6$ and $KV_{210}$, respectively, and provides corresponding signals. Multipliers 165, 166 multiply signal S with a direct current voltage $C_{18}$ and signal $E_6$, respectively, to provide product signals. Multipliers 169, 170 multiply signal $KV_{210}$ with signals $E_6$ and API, respectively, to provide product signals. Multipliers 175 through 180 multiply the signals from multipliers 160, 166, 161, 169, 162 and 170, respectively, with direct current voltages $C_{21}$, $C_{24}$, $C_{20}$, $C_{23}$, $C_{19}$ and $C_{22}$, respectively, to provide signals corresponding to the terms $C_{21}(S)^2$, $C_{24}(VI)(S)$, $C_{20}(VI)^2$, $C_{23}(KV_{210})(VI)$, $C_{19}(KV_{210})^2$ and $C_{22}(API)(KV_{210})$, respectively in equation 8. Summing means 182 sums the signals from multipliers 175, 176, 177, 179 and 180, to effectively sum the positive terms of equation 8, and provides a corresponding sum signal. The negative terms of equation 8 are effectively summed when summing means 185 sums the signals from multipliers 165, 178 with a direct current voltage $C_{17}$. Subtracting means 187 subtracts the signal provided by summing means 185 from the signal provided by summing means 182 to provide signal $E_9$.

Figure 11:
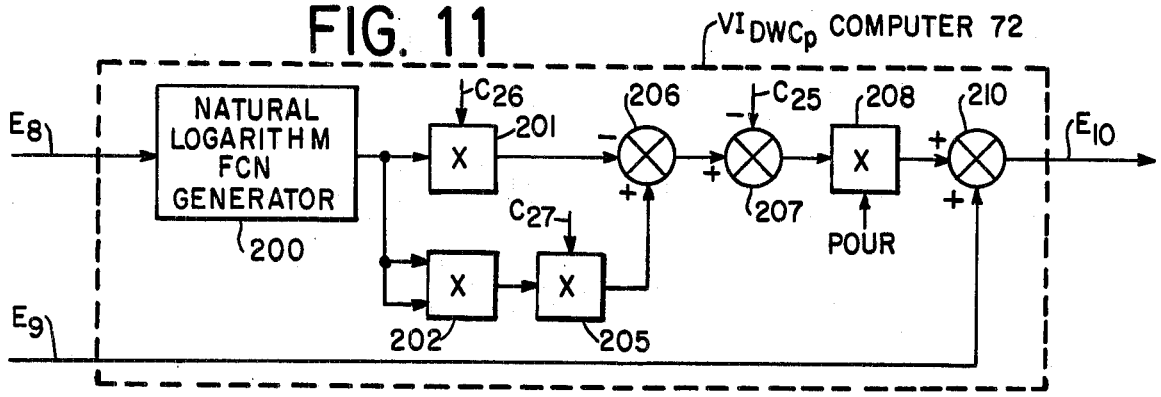

$VI_{DWCP}$ computer 72 shown in FIG. 11, includes a natural logarithm function generator 200 receiving signal $E_8$ and providing a signal corresponding to the term $LnSUS_{210}$ to multipliers 201 and 202. Multiplier 201 multiplies the signal from function generator 200 with a direct current voltage $C_{26}$ to provide a signal corresponding to the term $C_{26}\,LnSUS_{210}$ in equation 9. Multiplier 202 effectively squares the signal from function generator 200 to provide a signal that is multiplied with a direct current voltage $C_{27}$ by a multiplier 205. Multiplier 205 provides a signal corresponding to the term $C_{27}(LnSUS_{210})^2$ in equation 9. Subtracting means 206 subtracts the signals provided by multiplier 201 from the signal provided by multiplier 205. Summing means 207 sums the signal from the subtracting means 206 with a direct current voltage $C_{25}$. A multiplier 208 multiplies the sum signals from summing means 207 with a direct current voltage POUR to provide a signal which is summed with signal $E_9$ by summing means 210 which provides signal $E_{10}$.

Figure 12:
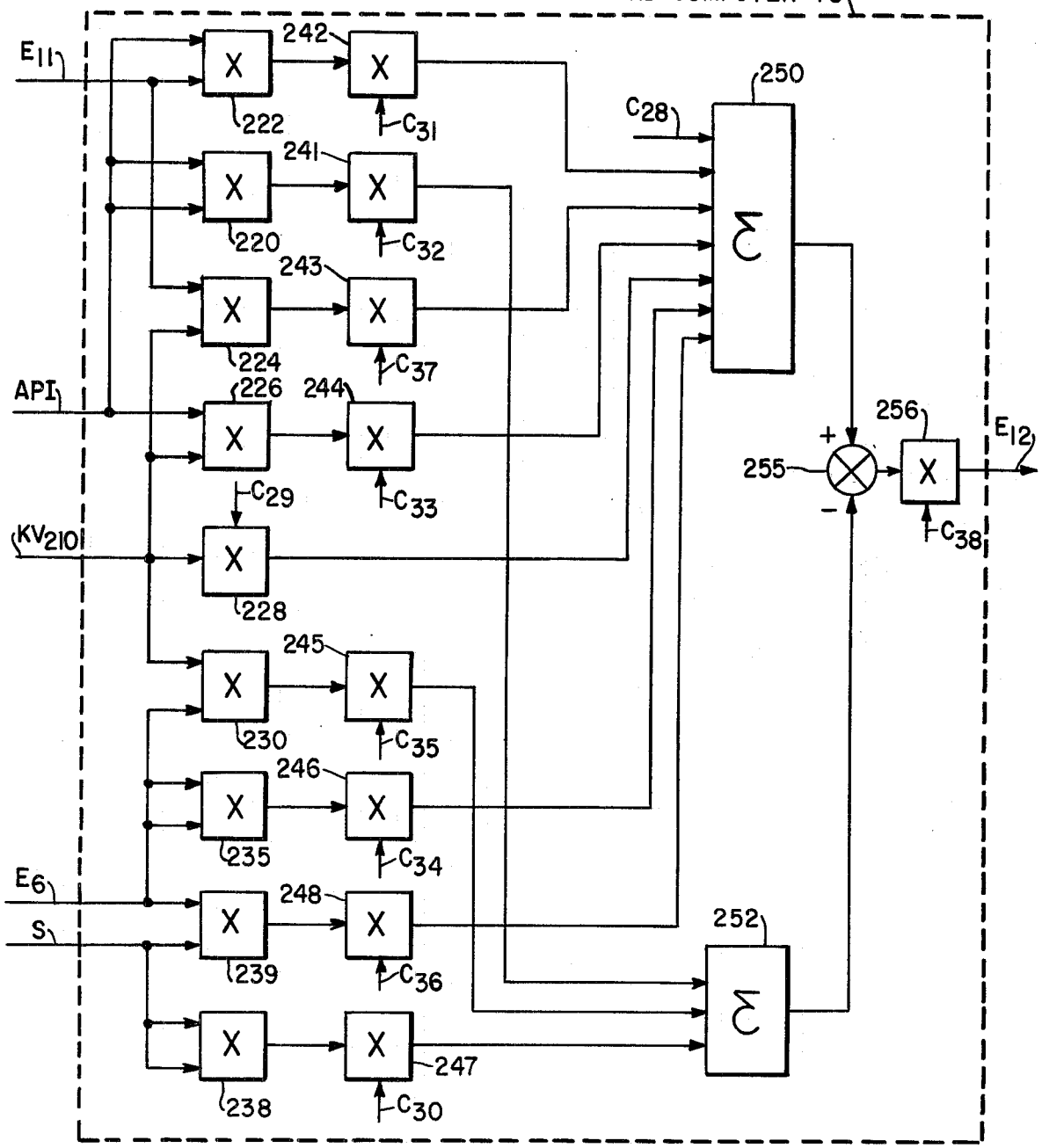

Referring to FIG. 12, multiplier 220 in ΔRI computer 78 effectively squares signal API while multipliers 222 and 224 multiply signal $E_{11}$ with signals API and $KV_{210}$, respectively, to provide product signals. Multipliers 226, 228 and 230 multiply signal $KV_{210}$ with signal API, a direct current voltage $C_{29}$ and signal $E_6$, respectively. Multipliers 235, 238 effectively square signals $E_6$ and S, respectively, while multiplier 239 multiplies signals $E_6$ and S to provide a product signal. Multipliers 241 and 248 multiply the product signals from multipliers 220, 222, 224, 226, 230, 235, 238 and 239, respectively, with direct current voltages $C_{32}$, $C_{31}$, $C_{37}$, $C_{35}$, $C_{34}$, $C_{30}$ and $C_{36}$, respectively, to provide signals corresponding to the terms $C_{32}(API)^2$, $C_{31}(\Delta VI)(API)$, $C_{37}(\Delta VI)(KV_{210})$, $C_{33}(API)(KV_{210})$, $C_{35}(VI)(KV_{210})$, $C_{34}(VI)^2$, $C_{30}(S)^2$ and $C_{36}(VI)(S)$, respectively, in equation 11. Summing means 250 effectively sums the positive terms of equation 11 when it sums a direct current voltage $C_{28}$ with the signals from multipliers 228, 242, 243, 244, 246 and 248 to provide a sum signal. Summing means 252 effectively sums the negative terms of equation 11 when it sums the signals from multipliers 241, 245 and 247 to provide a sum signal. subtracting means subtracts the sum signal provided by summing means 252 from the sum signal provided by summing means 250 to provide a signal which is multiplied with a direct current voltage $C_{38}$ by a multiplier 256. Multiplier 256 provides signal $E_{12}$.

Figure 13:
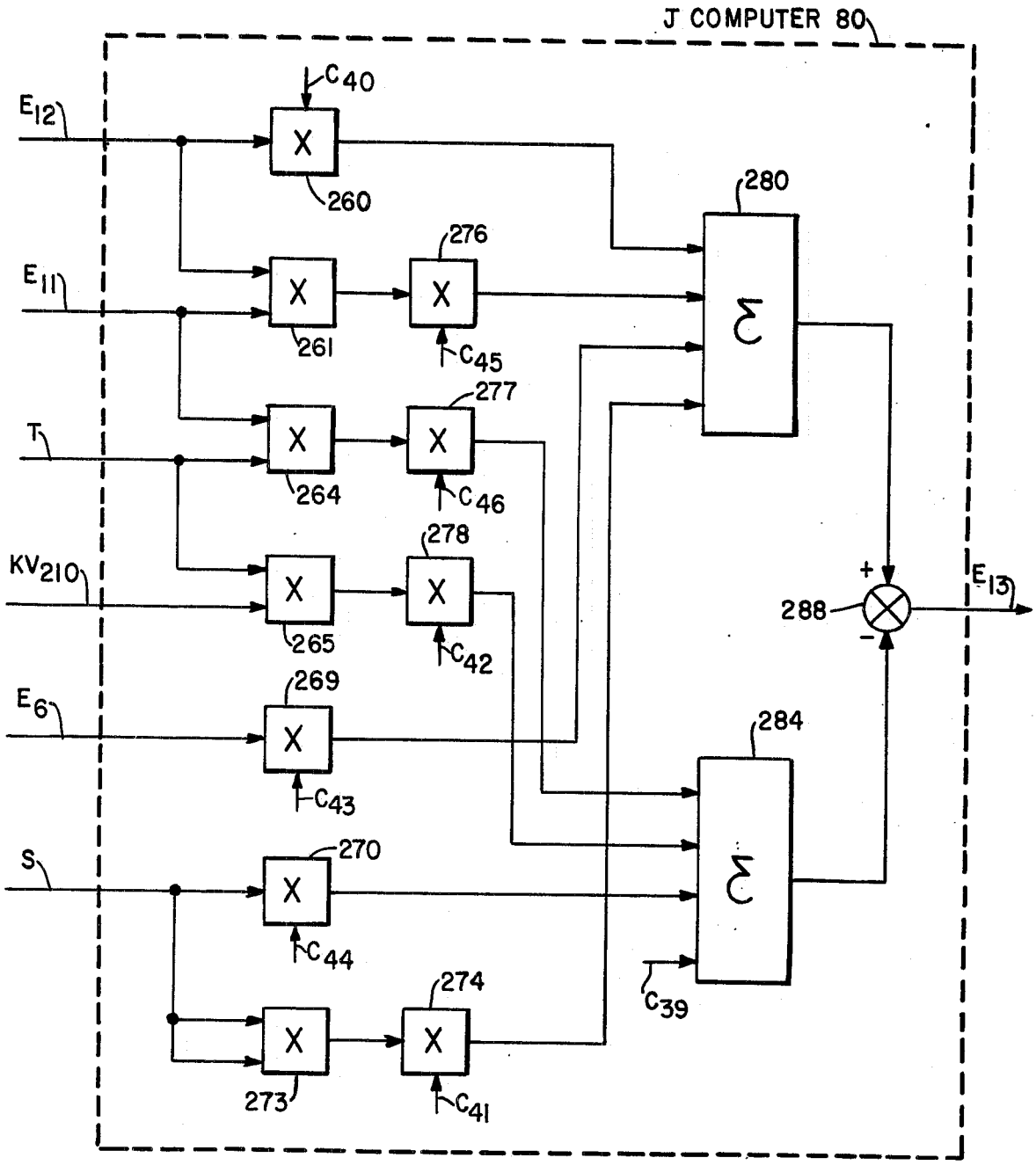

Referring now to FIG. 13, J computer 80 includes multipliers 260, 261 multiplying signal $E_{12}$ with a direct current voltage $C_{40}$ and signal $E_{11}$, respectively, to provide product signals. Multipliers 264, 265 multiply signal T with signals $E_{11}$ and $KV_{210}$, respectively, to provide product signals. Multipliers 269, 270 multiply signals $E_6$ and S, respectively, with direct current voltages $C_{43}$ and $C_{44}$, respectively, to provide signals corresponding to the terms $C_{43}(VI)$ and $C_{44}(S)$, respectively, in equation 12. A multiplier 273 effectively squares signal S to provide a signal which is multiplied with a direct current voltage $C_{41}$ by a multiplier 274 to develop a signal corresponding to the term $C_{41}(S)^2$ in equation 12. Multipliers 276, 277 and 278 multiply the signals from multipliers 261, 264 and 265, respectively, with direct current voltages $C_{45}$, $C_{46}$ and $C_{42}$, respectively, to provide signals corresponding to the terms $C_{45}(\Delta RI)(\Delta VI)$, $C_{46}(\Delta VI)(T)$ and $C_{42}(KV_{210})(T)$, respectively.

Summing means 280 sums the positive terms of equation 12 when it sums the signals from multipliers 260, 269, 274 and 276 to provide a corresponding signal. Summing means 284 effectively sums the negative terms of equation 12 when it sums a direct current voltage $C_{39}$ with the signals from multipliers 270, 277 and 278 to provide a sum signal. Subtracting means 288 subtracts the signal provided by subtracting means 280 to provide signal $E_{13}$.

Figure 14:
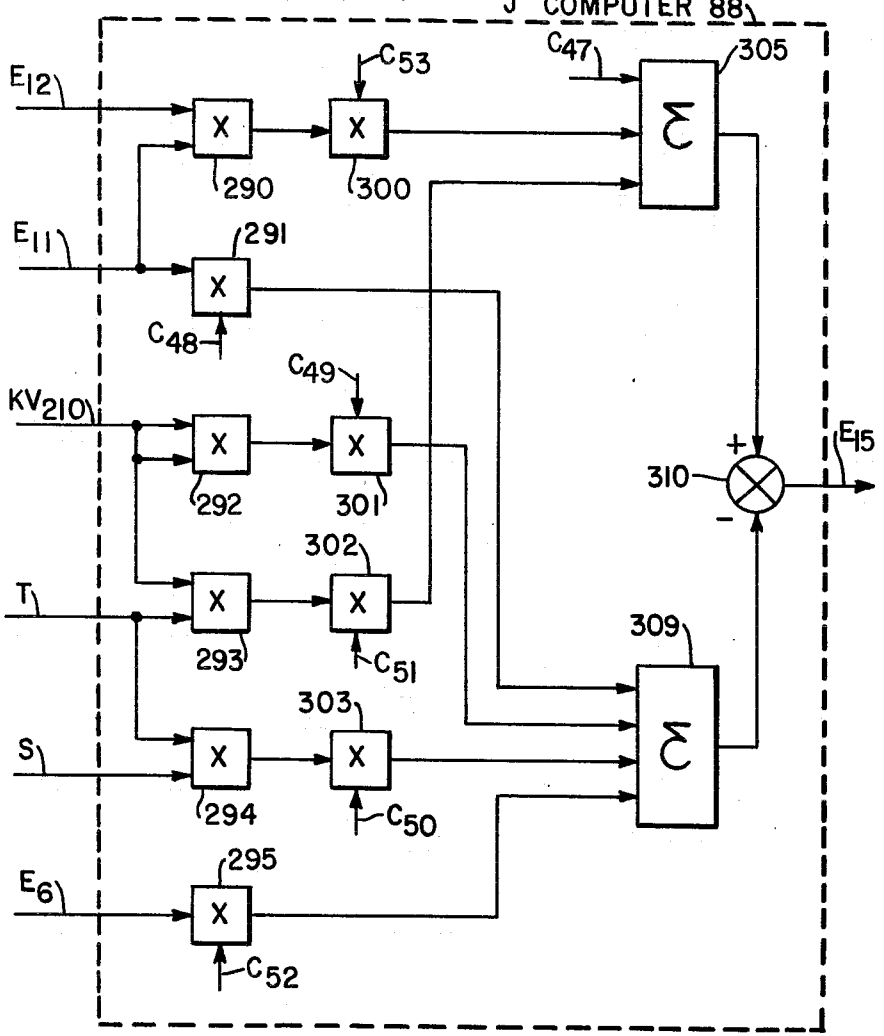

Referring now to FIG. 14, J computer 88 includes multipliers 290, 291 which multiply signal $E_{11}$ with signal $E_{12}$ and a direct current voltage $C_{48}$, respectively. Multiplier 292 effectively squares signal $KV_{210}$ while multipliers 293 and 294 multiply signal T with signals $KV_{210}$ and S, respectively, to provide product signals. Multiplier 295 multiplies signal $E_6$ with a direct current voltage $C_{52}$ to provide a signal corresponding to the term $C_{52}(VI)$ in equation 14. Multipliers 300 through 303 multiply the signals from multipliers 290, 292, 293 and 294, respectively, with direct current voltages $C_{53}$, $C_{49}$, $C_{51}$ and $C_{50}$, respectively, to provide signals corresponding to the terms $C_{53}(\Delta VI)(\Delta RI)$, $C_{49}(KV_{210})^2$, $C_{51}(KV_{210})(T)$ and $C_{50}(S)(T)$ in equation 14. Summing means 305 effectively sums the positive terms of equation 14 when it sums a direct current voltage $C_{47}$ with the product signals from multipliers 300 and 302 to provide a sum signal. Summing means 309 effectively sums the negative terms of equation 14 when it sums the product signals from multipliers 291, 295, 301 and 303 to provide a sum signal. Subtracting means 310 subtracts the sum signal provided by summing means 309 from the sum signal provided by summing means 305 to provide signal $E_{15}$.

Figure 15:
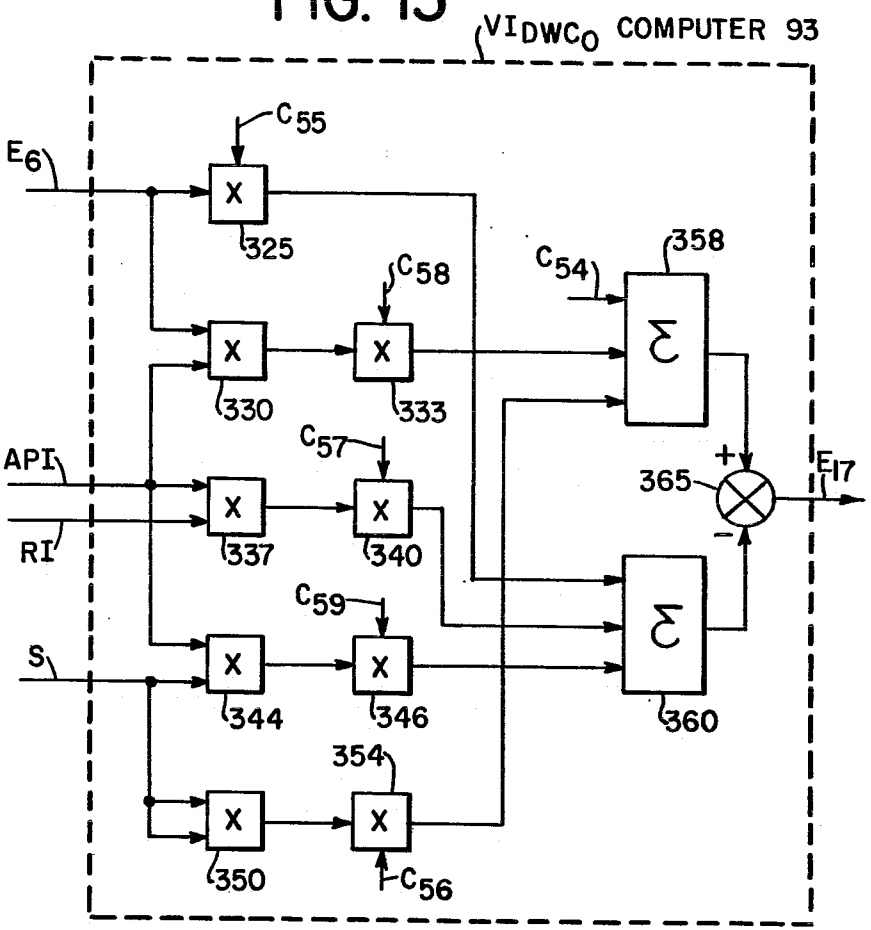

Referring now to FIG. 15, $VI_{DWCO}$ computer 93 includes a multiplier 325 multiplying signal $E_6$ with a direct current voltage $C_{55}(VI)$ in equation 15. A multiplier 330 multiplies signals $E_6$ and API to provide a signal to another multiplier 333 where it is multiplied with a direct current voltage $C_{58}$. Multiplier 333 provides a signal corresponding to the term $C_{58}$(API)(VI) in equation 15. A multiplier 337 multiplies signals API and RI to provide a signal which is multiplied with a direct current voltage $C_{57}$ by a multiplier 340 which provides a signal corresponding to the term $C_{57}$(RI)(API). Signals S and API are multiplied by a multiplier 344 to provide a signal to yet another multiplier 346 where it is multiplied with a direct current voltage $C_{59}$. Multiplier 346 provides a signal corresponding to the term $C_{59}$(API)(S). A multiplier 350 effectively squares signal S and provides a signal to another multiplier 354 where it is multiplied with direct current voltage $C_{56}$. Multiplier 354 provides a signal corresponding to the term $C_{56}(S)^2$.

Summing means 358 effectively sums the positive terms in equation 15 by summing the signals from multipliers 333 and 354 with a direct current voltage $C_{54}$ to provide a sum signal. Summing means 360 effectively sums the negative terms in equation 15 when it sums the signals from multipliers 325, 340 and 346 to provide a sum signal. Subtracting means 365 subtracts the sum signal provided by summing means 360 from the sum signal provided by summing means 358 to provide signal $E_{17}$.

Figure 16:
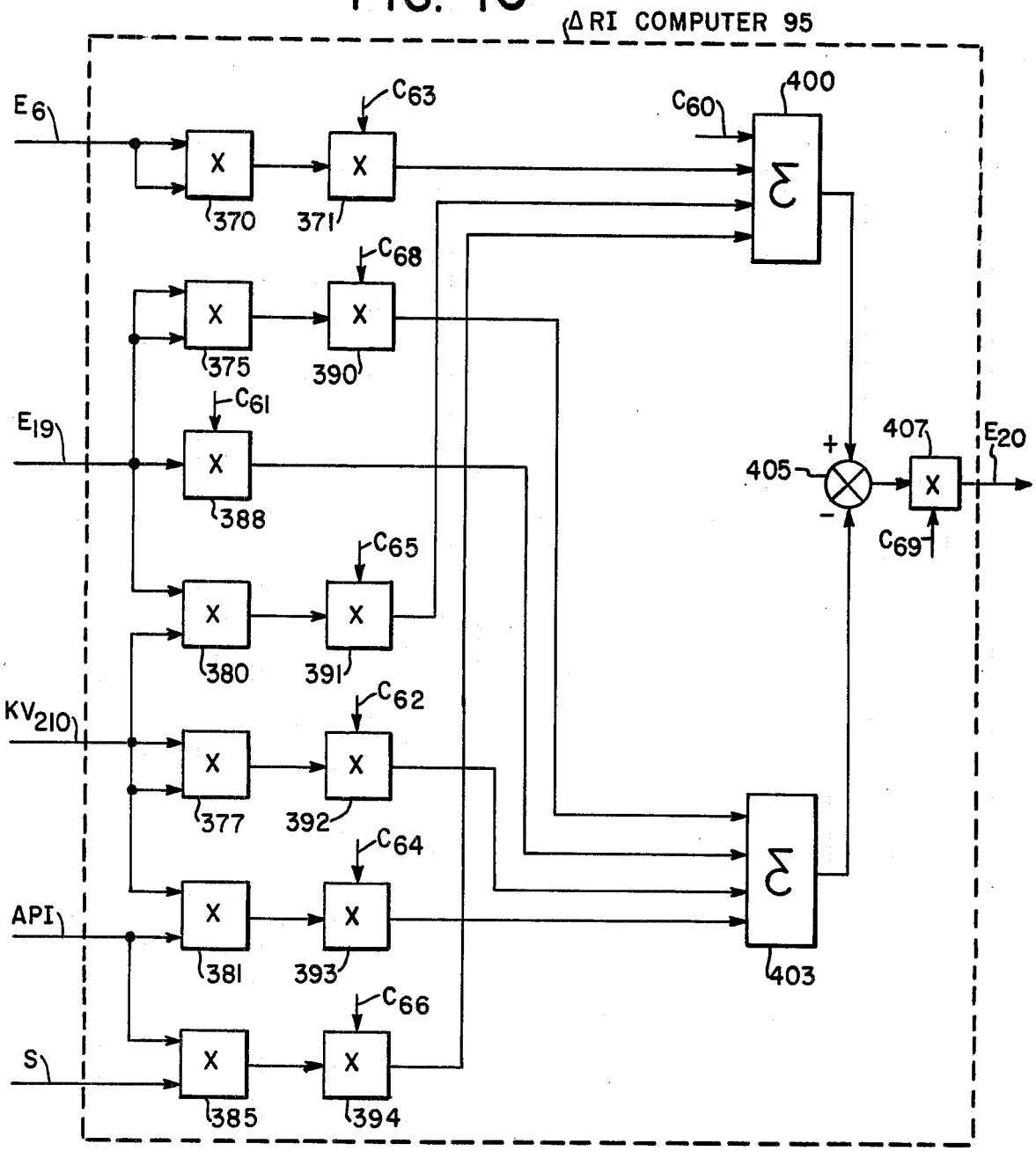

Referring now to FIG. 16, ΔRI computer 95 includes multipliers 370, 375 and 377 which effectively square signals $E_6$, $E_{19}$ and $KV_{210}$, respectively. Multipliers 380, 381 multiply signal $KV_{210}$ with signals $E_{19}$ and API, respectively. A multiplier 385 multiplies signals API and S to provide a product signal while a multiplier 388 multiplies signal $E_{19}$ with a direct current voltage $C_{61}$ to provide a signal corresponding to the term $C_{61}$(ΔVI). Multipliers 371, 390, 391, 392, 393, and 394 multiply the product signals from multipliers 370, 375, 380, 377, 381 and 385, respectively, with direct current voltages $C_{63}$, $C_{68}$, $C_{65}$, $C_{62}$, $C_{64}$ and $C_{66}$, respectively, to provide signals corresponding to the terms $C_{63}(VI)^2$, $C_{68}$ $C_{68}(\Delta VI)^2$, $C_{65}(\Delta VI)$, $(KV_{210})C_{62}(KV_{210})^2$, $C_{64}(KV_{210})$(API) and $C_{66}$(API)(S), respectively.

Summing means 400 effectively sums the positive terms of equation 16 by summing signals from multipliers 371,391 and 394 with a direct current voltage $C_{60}$ to provide a sum signal. Summing means 403 effectively sums the negative terms of equation 16 when it sums the signals from multipliers 388, 390, 392 and 393 to provide a sum signal. Subtracting means 405 subtracts the signal provided by summing means 403 from the signal provided by summing means 400 to provide a signal to a multiplier 607. Multiplier 407 multiplies the signal with a direct current voltage $C_{69}$ to provide signal $E_{20}$.

Figure 17:
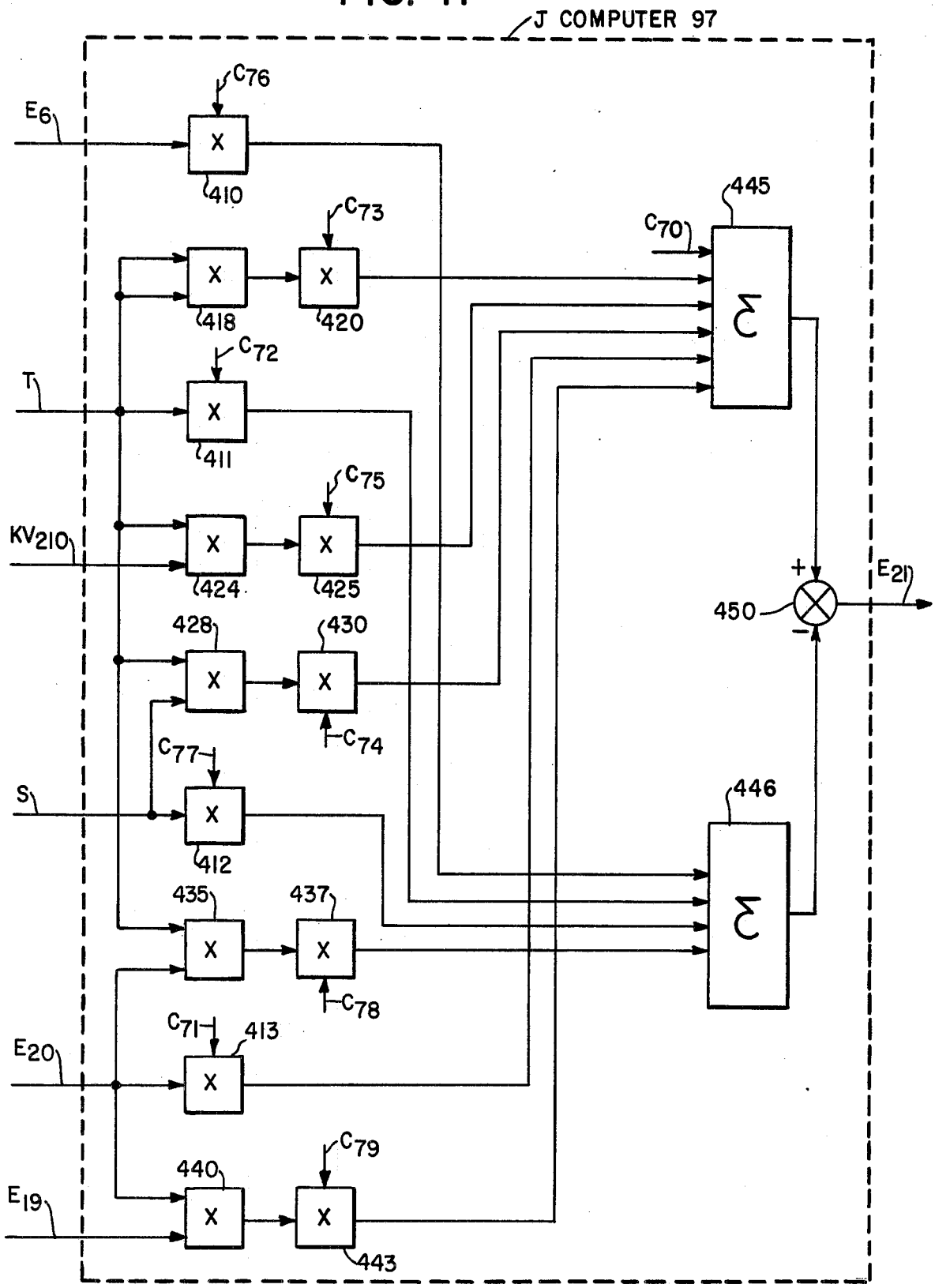

Referring now to FIG. 17, J computer 97 includes multipliers 410, 411, 412 and 413 multiplying signals $E_6$, T, S and $E_{20}$, respectively, with direct current voltages $C_{76}$, $C_{72}$, $C_{77}$ and $C_{71}$, respectively, corresponding to the terms $C_{76}$(VI), $C_{72}$(T), $C_{77}$(S) and $C_{71}$(ΔRI), respectively, in equation 17. Multiplier 418 effectively squares signal T and provides a product signal to another multiplier 420 where it is multiplied with a direct current voltage $C_{73}$ to provide a signal corresponding to the term $C_{73}(T)^2$. Multiplier 424 multiplies signals T, $KV_{210}$ to provide a signal to a multiplier 425 where it is multiplied with a direct current voltage $C_{75}$. Multiplier 425 provides a signal corresponding to the term $C_{75}(KV_{210})$(T) in equation 17. Signals S, T are multiplied by a multiplier 428 to provide a signal to yet another multiplier 430 where it is multiplied with a direct current voltage $C_{74}$. Multiplier 430 provides a signal corresponding to the term $C_{74}$(S)(T). Signals T and $E_{20}$ are multiplied by a multiplier 435 which provides a signal to a multiplier 437 where it is multiplied with a direct current voltage $C_{78}$ to provide a signal corresponding to the term $C_{78}$(ΔRI)(T). A multiplier 440 multiplies signals $E_{19}$, $E_{20}$ to provide a signal to a multiplier 443 where it is multiplied with a direct current voltage $C_{79}$ to provide a signal corresponding to the term $C_{79}$(ΔRI)(ΔVI).

Summing means 445 effectively sums the positive terms of equation 17 when it sums a direct current voltage $C_{70}$ with the signals from multipliers 420, 425, 430, 413 and 443 to provide a sum signal. Summing means 446 effectively sums the negative terms of equation 17 when it sums the signals from multipliers 410, 411, 412 and 437 to provide a sum signal. Subtracting means 450 subtracts the sum signal provided by summing means 446 from the sum signal provided by summing means 445 to provide signal $E_{21}$.

Figure 18:
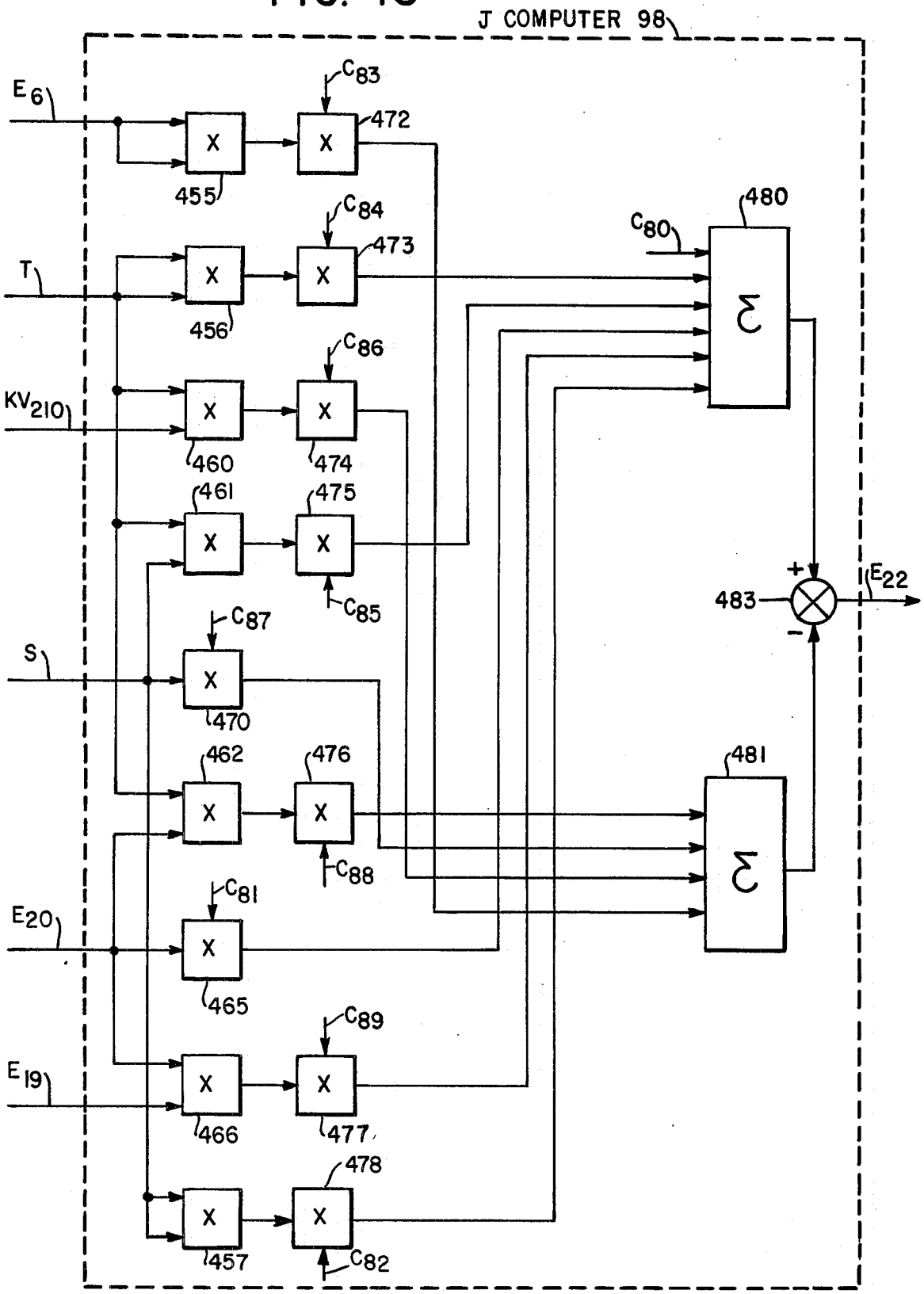

Referring now to FIG. 18, multipliers 455, 456 and 457 effect square signals $E_6$, T and S, respectively. Multipliers 460, 461 and 462 multiply signal T with signals $KV_{210}$, S and $E_{20}$, respectively, to provide product signals. Multipliers 465, 466 multiply signal $E_{20}$ with a direct current voltage $C_{81}$ and signal $E_{19}$, respectively, while multiplier 470 multiplies signal S with a direct current voltage $C_{87}$ to provide a product signal. Multipliers 472, 473, 474, 475, 476, 477 and 478 multiply the signals from multipliers 455, 456, 460, 461, 462, 466 and 457, respectively, with direct current voltages $C_{83}$, $C_{84}$, $C_{85}$, $C_{86}$, $C_{88}$, $C_{89}$ and $C_{82}$, respectively, to provide signals corresponding to the terms $C_{83}(VI)^2$, $C_{84}(T)^2$, $C_{86}(KV_{210})$(T), $C_{85}$(S)(T), $C_{88}$(ΔRI)(T), $C_{89}$(ΔRI)(ΔVI) and $C_{82}(S)^2$, respectively, in equation 18.

Summing means 480 effectively sums all positive terms of equation 18 when it sums a direct current voltage. $C_{80}$ with the signals from multipliers 465, 473, 475, 477 and 478 to provide a sum signal. A sum signal corresponding to the summation of the negative terms in equation 18 is provided by summing means 481 which sums the signals from multipliers 470, 472, 474 and 476. Subtracting means 483 subtracts the signal provided by summing means 481 from the signal provided by summing means 480 to create signal $E_{22}$.

Figure 19:
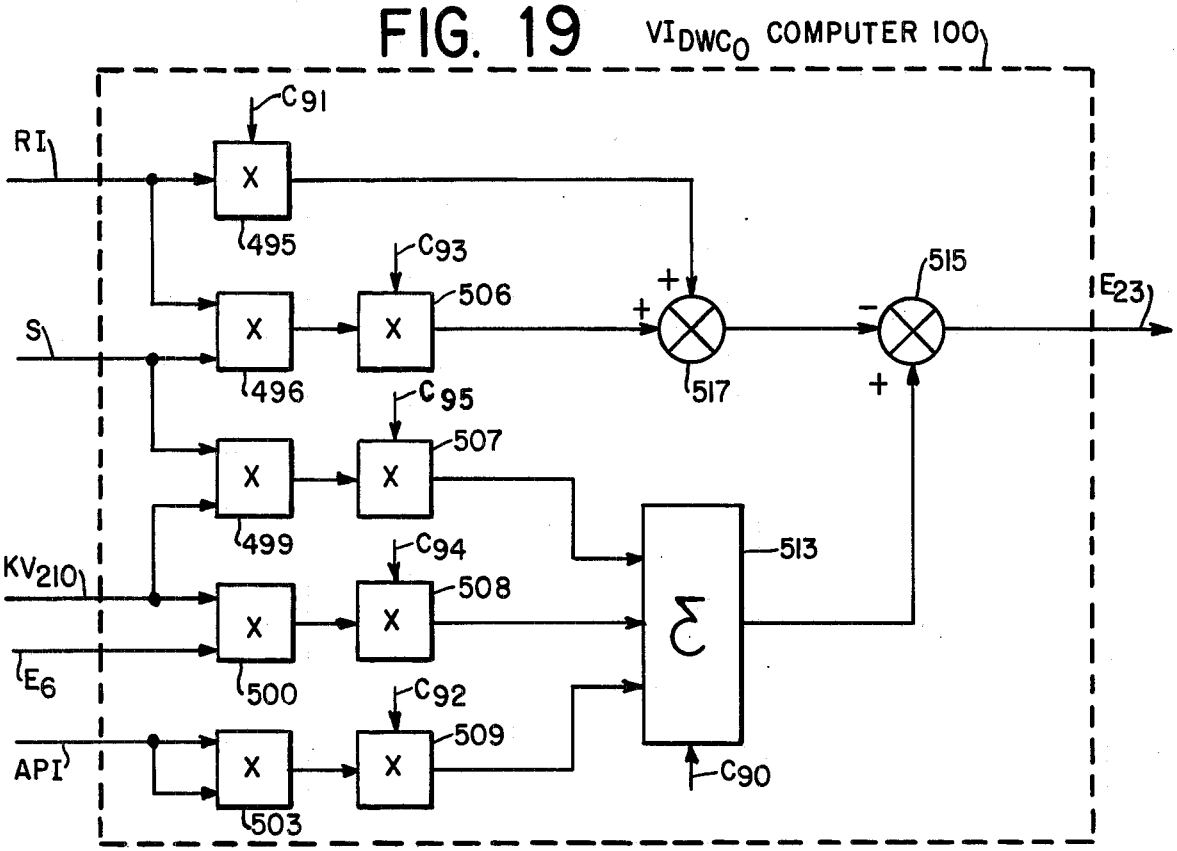

Referring not to FIG. 19, $VI_{DWCO}$ computer 100 includes multipliers 495, 496 which multiply signal RI with a direct current voltage $C_{91}$ and signal S, respectively, to provide product signals. Multipliers 49, 500 multiply signal $KV_{210}$ with signals S and $E_6$, respectively, to provide product signals. Multiplier 503 effectively squares signal API. Multipliers 506, 507, 508 and 509 multiply signals from multipliers 496, 499, 500 and 503, respectively, with direct current voltages $C_{93}$, $C_{95}$, $C_{94}$ and $C_{92}$, respectively, to provide signals corresponding to the term $C_{93}$(RI)(S), $C_{95}(KV_{210})$(S), $C_{94}(KV_{210})$(VI) and $C_{92}(API)^2$, respectively, in equation 19. Summing means 513 effectively sums the positive terms of equation 19 when it sums a direct current voltage $C_{90}$ with signals from multipliers 507, 508 and 509 to provide a sum signal to subtracting means 515. Summing means 517 effectively sums the negative terms in equation 19 when it sums the signals from multipliers 495 and 506 to provide a signal to subtracting means 515 where it is subtracted from the signal from summing means 513. Subtracting means 515 provides signal $E_{23}$.

Figure 20:
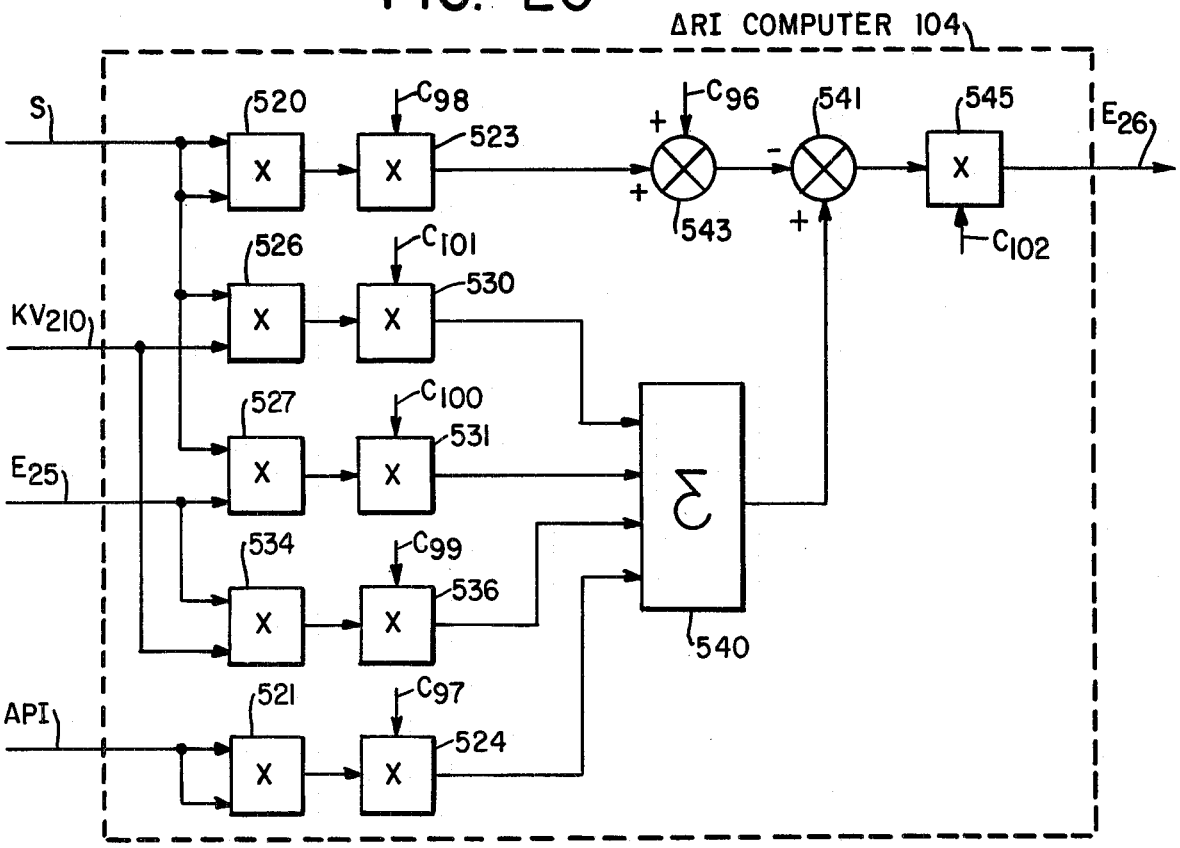

Referring now to FIG. 20, ΔRI computer 104 includes multipliers 520, 521 which effectively square signals S, API to provide product signals to multipliers 523 and 524, respectively where they are multiplied with direct current voltages $C_{98}$ and $C_{97}$, respectively. Multipliers 523, 524 provide signals corresponding to the terms $C_{98}(S)^2$ and $C_{97}(API)^2$, respectively, in equation 20. Multipliers 526, 527 multiply signal S with signals $KV_{210}$ and $E_{25}$ to provide signals to multipliers 530 and 531, respectively, where they are multiplied with direct current voltages $C_{101}$ and $C_{100}$, respectively. Multipliers 530, 531 provide signals corresponding to the terms $C_{101}(KV_{210})(S)$ and $C_{100}(\Delta VI)(S)$, respectively. A multiplier 534 multiplies signals $KV_{210}$, $E_{25}$ to provide a signal to another multiplier 536 where it is multiplied with a direct current voltage $C_{99}$ to provide a signal corresponding to the term $C_{99}(\Delta VI)(KV_{210})$. Summing means 200 effectively sums the positive term of equation 20 when it sums signals from multipliers 524, 530, 531 and 536 to provide a sum signal to subtracting means 541. Summing means 543 effectively sums the negative terms of equation 20 when it sums a direct current voltage $C_{96}$ with the signals from multiplier 523 to provide a signal which is substracted from the signal provided by summing means 540 by subtracting means 541. Subtracting means 541 provides a signal which is multiplied with a direct current voltage $C_{102}$ by a multiplier 545 to provide signal $E_{26}$.

Figure 21:
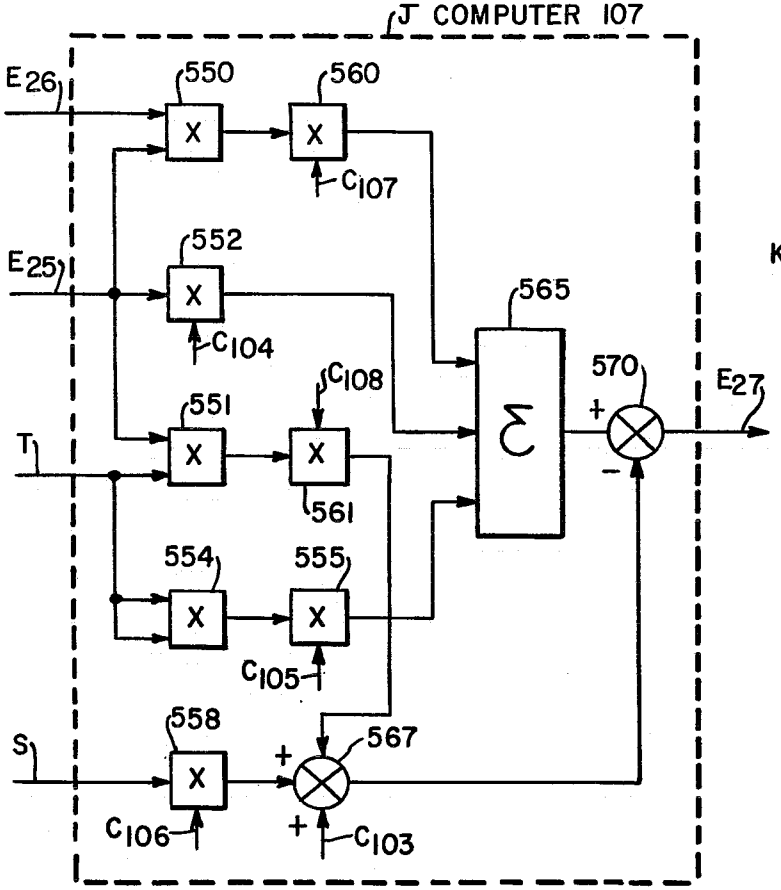

Referring now to FIG. 21, J computer 107 includes multipliers 550, 551 and 552 multiplying signal $E_{25}$ with signals $E_{26}$, T, and a direct current voltage $C_{104}$, respectively. A multiplier 554 effectively squares signal T and provides it to another multiplier 555 where it is multiplied with a direct current voltage $C_{105}$. Multiplier 555 provides a signal corresponding to the term $C_{105}(T)^2$ in equation 21. A multiplier 558 multiplies signal S with a direct current voltage $C_{106}$ to provide a signal corresponding to the term $C_{106}(S)$ in equation 21. Multipliers 560, 561 multiply the signals from multipliers 550 and 551, respectively, with direct current voltages $C_{107}$ and $C_{108}$, respectively, to provide signals corresponding to the term $C_{107}(\Delta RI)(\Delta VI)$ and $C_{108}(\Delta VI)(T)$, respectively, in equation 21. Summing means 565 effectively sums the positive terms in equation 21 when it sums the signals from multipliers 552, 555 and 566 to provide a sum signal. Summing means 567 effectively sums the negative terms of equation 21 when it sums the signal from multiplier 558 with a direct current voltage $C_{103}$. Subtracting means 570 subtracts the signal from summing means 567 from the signal provided by summing means 565 to provide signal $E_{27}$.

Figure 22:
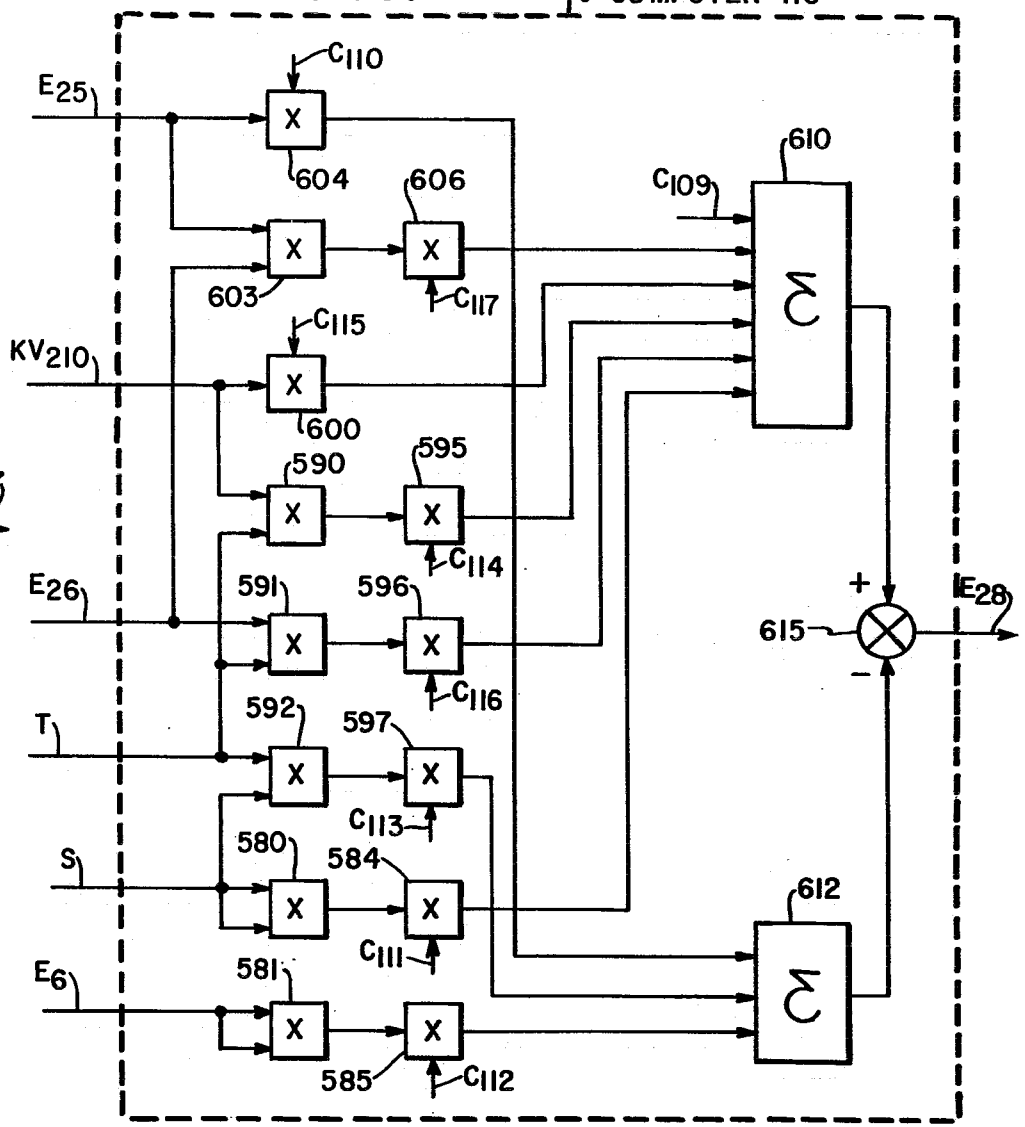

Referring now to FIG. 22 in J computer 110, multipliers 580, 581 effectively square signals S and $E_6$, respectively, where they are multiplied with direct current voltages $C_{111}$ and $C_{112}$, respectively. Multipliers 584, 585 provide signals corresponding to the terms $C_{111}(S)^2$ and $C_{112}(VI)^2$, respectively. Multipliers 590, 591 and 592 multiply signal T with signals $KV_{210}$, $E_{26}$ and S, to provide product signals to multipliers 595, 596 and 597, respectively. Multipliers 595, 596 and 597 multiply the product signals with direct current voltages $C_{114}$, $C_{116}$ and $C_{113}$, respectively, to provide signals corresponding to the terms $C_{114}(KV_{210})(T)$, $C_{116}(\Delta RI)(T)$ and $C_{113}(S)(T)$, respectively. A multiplier 600 multiplies signal $KV_{210}$ with a direct current voltage $C_{115}$ to provide a signal corresponding to the term $C_{115}(KV_{210})$ in equation 22. Multipliers 603, 604 multiply signal $E_{25}$ with signals $E_{26}$ and a direct current voltage $C_{110}$. Multiplier 603 provides a product signal to another multiplier 606 where it is multiplied with a direct current voltage $C_{117}$ to provide a signal corresponding to the term $C_{117}(\Delta RI)(\Delta VI)$ in equation 22. Summing means 610 effectively sums the positive terms of equation 22 when it sums a direct current voltage $C_{109}$ with the signals from multipliers 584, 595, 596, 600 and 606 to provide a sum signal. Summing means 612 effectively sums the negative terms of equation 22 when it sums the signals from multipliers 585, 597 and 604 to provide a sum signal. Subtracting means 615 subtracts the sum signal provided by summing means 612 from the signals provided by summing means 610 to provide signal $E_{28}$.

Figure 23:
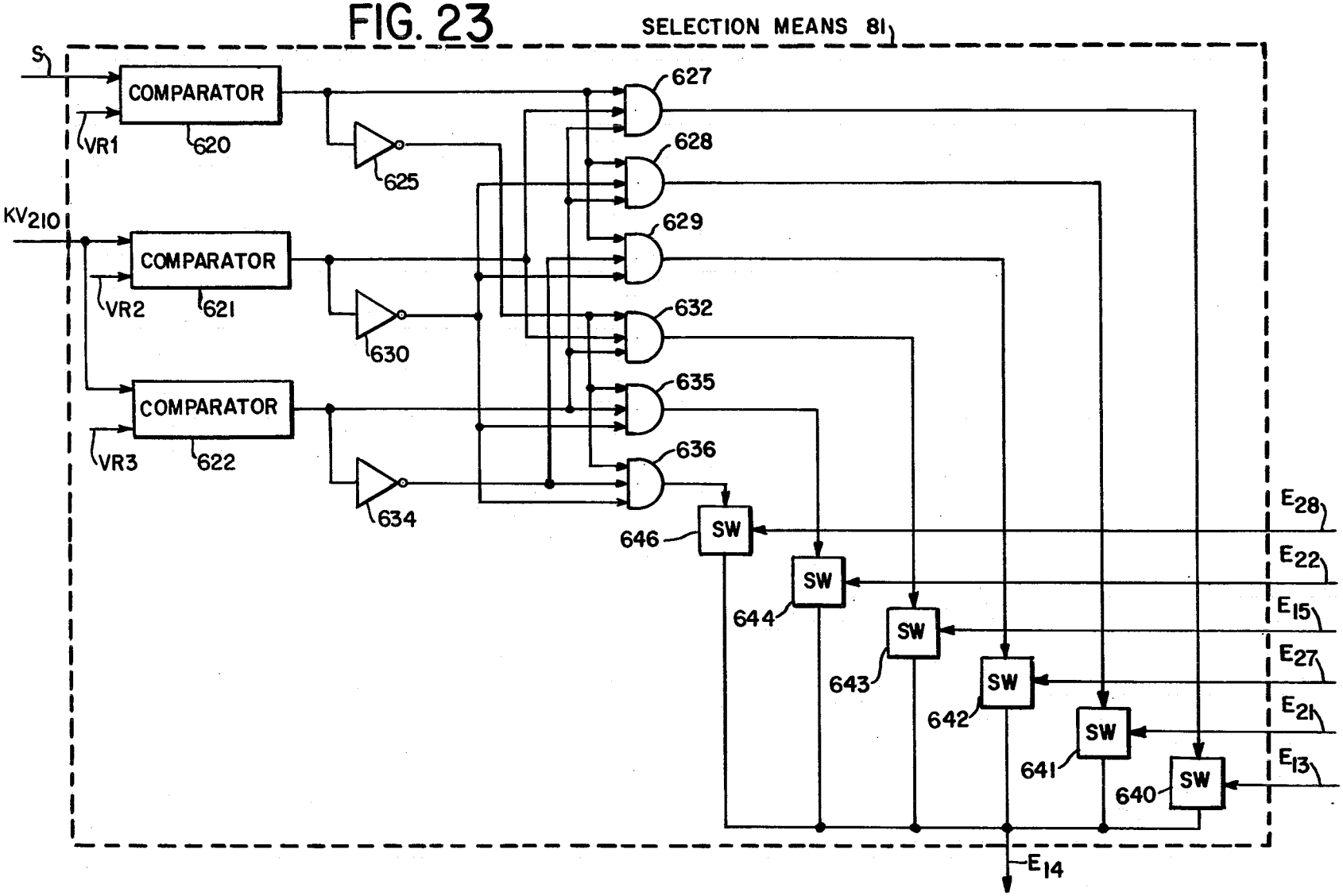

Selection means 81 in FIG. 23 includes comparators 620, 621 and 622. Comparator 620 compares signal S with a reference voltage $VR_1$ corresponding to a predetermined percent sulfur content of the charge oil, preferably about 1.0%, to determine whether the charge oil is sweet or sour. For sweet charge oil, comparator 620 provides a high level output, while for sour charge oil it provides a low level output. The output from comparator 620 is applied to an inverter 625 and to AND gates 627, 628 and 629.

Comparators 621 and 622 compare signal $KV_{210}$ with reference voltages $VR_2$ and $VR_3$ corresponding to predetermined kinematic viscosities, preferably about 7.0 and 15.0, respectively, and they determine whether the charge oil is light, medium or heavy. For light charge oil, comparators 621, 622 provide high level outputs. For medium charge oil, comparators 621 and 622 provide a low level output and a high logic level output, respectively. For heavy charge oil, comparators 621 and 622 provide low level outputs.

Comparator 620 provides its output to an inverter 625 and to AND gates 627, 628 and 629. Comparator 621 provides its output to an inverter 630 and to AND gates 627 and 632. Comparator 622 provides its output to inverter 634 to AND gates 627, 628, 632 and 635. Inverter 625 provides its output to AND gates 632, 635, and 636. Inverter 630 provides its output to AND gates 628, 629, 635 and 636. Inverter 634 provides its output to AND gates 629 and 636.

AND gates 627, 628, 629, 632, 635 and 636 decode the outputs of comparators 620, 621 and 622 and inverters 625, 630 and 634 to control switches 640 through 646 respectively, receiving signals $E_{13}$, $E_{21}$, $E_{27}$, $E_{15}$, $E_{22}$ and $E_{28}$, respectively. A high logic level (H) output from an AND gate renders a corresponding switch conductive to provide the signal the switch receives as signal $E_{14}$. A low logic level (L) output from the AND gate renders the switch nonconductive. The following table correlates the logic level of the AND gates to the type of charge oil.

| CHARGE | AND GATES | | | | | |
|---|---|---|---|---|---|---|
| OIL | 627 | 628 | 629 | 632 | 635 | 636 |
| LIGHT SWEET | H | L | L | L | L | L |
| LIGHT SOUR | L | L | L | H | L | L |
| MEDIUM SWEET | L | H | L | L | L | L |
| MEDIUM SOUR | L | L | L | L | H | L |
| HEAVY SWEET | L | L | H | L | L | L |
| HEAVY SOUR | L | L | L | L | L | H |

The present invention is hereinbefore described as a control system and method for controlling the operation of an MP refining unit as a function of certain quality factors of the charge oil being provided to it. More specifically, the unit is controlled as a function of the API gravity, the kinematic viscosities corrected to 210° F. and 150° F., the refractive index and the sulfur content of the charge oil to achieve more accurate control of the finished product being provided by the MP refining unit.

It would be obvious to one skilled in the art that the charge oil flow rate may be constant and the MP flow rate varied. For this condition, equation 13 is rewritten as:

$$SO=(CHG)(J)/100, \qquad 23.$$

where SO is the new MP flow rate. Of course, elements 84 and 85 would have to be rearranged so that signal $E_{14}$ is multiplied with signal CHG and the product signal divided by voltage $V_2$ to provide signal SO to a flow rate controller controlling a valve in line 7.

What is claimed is:

1. A control system for a refining unit receiving charge oil and N-methyl-2-pyrrolidone solvent, one of which is maintained at a fixed flow rate while the flow rate of the other is controlled by the control system, treats the received charge oil with the received N-methyl-2-pyrrolidone to yield extract and raffinate, comprising gravity analyzer means for sampling the charge oil and providing a signal API corresponding to the API gravity of the charge oil, viscosity analyzer means for sampling the charge oil and providing signals $KV_{150}$ and $KV_{210}$ corresponding to the kinematic viscosities, corrected to 150° F. and 210° F., respectively, sulfur analyzer for sampling the charge oil and providing a signal S corresponding to the sulfur content of the charge oil, a refractometer samples the charge oil and provides a signal RI corresponding to the refractive index of the charge oil, flow rate sensing means for sensing the flow rates of the charge oil and of the N-methyl-2-pyrrolidone and providing signals CHG and SOLV, corresponding to the charge oil flow rate and the N-methyl-2-pyrrolidone flow rate, respectively, means for sensing the temperature of the extract-mix and providing a corresponding signal T, and control means connected to all of the analyzer means, the refractometer, and to all the sensing means for controlling the other flow rate of the charge oil and the N-methyl-2-pyrrolidone flow rates in accordance with signals API, $KV_{150}$, $KV_{210}$, S, RI, CHG, T and SOLV.

2. A system as described in claim 1, in which the charge oil may be light sweet charge oil having a sulfur content equal to or less than a predetermined sulfur content and having a kinematic viscosity, corrected to a predetermined temperature, equal to or less than a first predetermined kinematic viscosity; light sour charge oil having a sulfur content greater than the predetermined sulfur content and having a kinematic viscosity, corrected to the predetermined temperature, equal to or less than the first predetermined kinematic viscosity; medium sweet charge oil having a sulfur content equal to or less than the predetermined sulfur content and having a kinematic viscosity, corrected to the predetermined temperature, greater than the first predetermined kinematic viscosity but equal to or less than a second predetermined kinematic viscosity; medium sour charge oil having a sulfur content greater than the predetermined sulfur content and having a kinematic viscosity, corrected to the predetermined temperature, greater than the first predetermined kinematic viscosity but equal to or less than the second predetermined kinematic viscosity; heavy sweet charge oil having a sulfur content equal to or less than the predetermined sulfur content and having a kinematic viscosity, corrected to the predetermined temperature, greater than the second predetermined kinematic viscosity, or heavy sour charge oil having a sulfur content greater than the predetermined sulfur content and having a kinematic viscosity, corrected to the predetermined temperature, greater than the second predetermined kinematic viscosity; and the control means includes a plurality of J signal means, each J signal means providing a signal J representative of an N-methyl-2-pyrrolidone dosage for a corresponding type of charge oil, selection means connected to the J signal means, to the viscosity analyzing means and to the sulfur analyzing means for selecting one of the J signals in accordance with one of the kinematic viscosity signals from the viscosity analyzer means and signal S and providing the selected J signal, control signal means connected to the selection means and to the flow rate sensing means for providing a control signal in accordance with the selected J signal and one of the sensed flow rate signals, and apparatus means connected to the control network means for controlling the one flow rate of the charge oil and N-methyl-2-pyrrolidone flow rates in accordance with the control signal.

3. A system as described in claim 2, in which the control means includes VI signal means connected to the viscosity analyzer means for providing a signal VI corresponding to the viscosity index of the charge oil in accordance with kinematic viscosity signals $KV_{150}$ and $KV_{210}$; $SUS_{210}$ signal means connected to the viscosity analyzer means for providing a signal $SUS_{210}$ corresponding to the charge oil viscosity in Saybolt Universal Seconds corrected to 210° F.; means connected to the viscosity analyzer means, to the gravity analyzer means, to the sulfur analyzer means, to the VI signal means and to the $SUS_{210}$ signal means and receiving a direct current voltage $VI_{RP}$ corresponding to the viscosity index of the refined oil at the predetermined temperature for providing a first signal ΔVI in accordance with signals $KV_{210}$, API, S, VI and $SUS_{210}$ and voltage $VI_{RP}$; second ΔVI signal means connected to the gravity analyzer means, to the sulfur analyzer means, to the refractometer, to the VI signal means, and to the $SUS_{210}$ signal means and receiving voltage $VI_{RP}$ for providing a second signal ΔVI corresponding to the change in viscosity index in accordance with signals VI, API, S, RI, $SUS_{210}$ and voltage $VI_{RP}$; third ΔVI signal means connected to the viscosity analyzer means, to the gravity analyzer means, to the sulfur analyzer means, to the VI signal means, to the refractometer, and to the $SUS_{210}$ signal means and receiving voltage $VI_{RP}$ for providing a third signal ΔVI corresponding to the change in viscosity index in accordance with signals $KV_{210}$, API, VI, S, RI and $SUS_{210}$ and voltage $VI_{RP}$; first ΔRI signal means connected to the viscosity analyzer means, to the sulfur analyzer means, to the first ΔVI signal means, to the gravity analyzer means and to the VI signal means for providing a first signal ΔRI corresponding to a change in the refractive index between the charge oil and the raffinate in accordance with the first ΔVI signal and signals $KV_{210}$, S, API and VI; second ΔRI signal means connected to the viscosity analyzer means, to the gravity analyzer means, to the viscosity analyzer means, to the second ΔVI signal means, to the VI signal means and to the sulfur analyzer means for providing a second signal ΔRI corresponding to a change in the refractive index between the charge oil and the raffinate in accordance with the second ΔVI signal and signals $KV_{210}$, API, VI and S; third ΔRI signal means connected to the gravity analyzer means, to the viscosity analyzer means, to the sulfur analyzer means, and to the third ΔVI signal means for providing a third signal ΔRI corresponding to a change in the refractive index between the charge oil and the raffinate in accordance with the third ΔVI signal and signals $KV_{210}$, S, and API, and the plurality of J signal means includes first J signal means connected to the first ΔVI signal means, to the first ΔRI signal means, to the temperature sensing means, to the sulfur analyzer means, to the VI signal means and to the selection means for providing a first J signal to the selection means corresponding to an N-methyl-2-pyrrolidone dosage for light sweet charge oil in accordance with the first ΔVI and ΔRI signals, and signals T, $KV_{210}$, VI and S, second J signal means connected to the first ΔVI signal means, to the first ΔRI signal means, to the temperature sensing means, to the sulfur analyzer means, to the viscosity analyzer means, to the VI signal means and to the selection means corresponding to the N-methyl-2-pyrrolidone dosage for light sour charge oil in accordance with the first signals ΔVI and ΔRI, and signals $KV_{210}$, S, VI and T, third J signal means connected to the second ΔVI signal means, to the second ΔRI signal means, to the temperature sensing means, to the sulfur analyzer means, to the viscosity analyzer means, to the VI signal means and to the selection means for providing a third J signal to the selection means corresponding to the N-methyl-2-pyrrolidone dosage for medium sweet charge oil in accordance with the second signals ΔVI and ΔRI, and signals $KV_{210}$, S, VI and T, fourth J signal means connected to the second ΔVI signal means, to the second ΔRI signal means, to the temperature sensing means, to the sulfur analyzer means, to the viscosity analyzer means, to the VI signal means and to the selection means for providing a fourth J signal to the selection means corresponding to the N-methyl-2-pyrrolidone dosage for medium sour charge oil in accordance with the second signals ΔVI and ΔRI, signals $KV_{210}$, S, VI and T, fifth J signal means connected to the third ΔVI signal means, to the third ΔRI signal means, to the sulfur analyzer means, to the temperature sensing means and to the selection means for providing a fifth signal J to the selection means corresponding to the N-methyl-2-pyrrolidone dosage for heavy sweet charge oil in accordance with the third signals ΔVI and ΔRI, signals S and T, and sixth J signal means connected to the third ΔVI signal means, to the third ΔRI signal means, to the temperature sensing means, to the sulfur analyzer means, to the viscosity analyzer means, to the VI signal means and to the selection means for providing a sixth J signal to the selection means in accordance with the third signals ΔRI and ΔVI, signals $KV_{210}$, S, VI and T.

4. A system as described in claim 3 in which the $SUS_{210}$ signal means includes SUS signal means connected to the viscosity analyzer means, and receiving direct current voltages $C_5$ through $C_{12}$ for providing a signal SUS corresponding to an interim factor SUS in accordance with signal $KV_{210}$, voltages $C_5$ through $C_{12}$ and the following equation:

$$SUS=C_5(KV_{210})+[C_6+C_7(KV_{210})]/[C_8+C_9(KV_{210})+C_{10}(KV_{210})^2+C_{11}(KV_{210})^3](C_{12}),$$

where $C_5$ through $C_{12}$ are constants; and $SUS_{210}$ network means connected to the SUS signal means and to all the ΔVI signal means and receiving direct current voltages $C_{13}$ through $C_{16}$ for providing signal $SUS_{210}$ to all the ΔVI signal means in accordance with signal SUS, voltages $C_{13}$ through $C_{16}$ and the following equation:

$$SUS_{210}=[C_{13}+C_{14}(C_{15}-C_{16})]SUS$$

where $C_{13}$ through $C_{16}$ are constants.

5. A system as described in claim 4 in which the VI signal means includes K signal means receiving direct current voltages $C_2$, $C_3$, $C_4$ and $T_{150}$ for providing a signal $K_{150}$ corresponding to the kinematic viscosity of the charge oil corrected to 150° F. in accordance with voltages $C_2$, $C_3$, $C_4$ and $T_{150}$, and the following equation:

$$K_{150}=[C_2-ln(T_{150}+C_3)]/C_4,$$

where $C_2$ through $C_4$ are constants, and $T_{150}$ corresponds to a temperature of 150° F.; $H_{150}$ signal means connected to the viscosity analyzer means and receiving a direct current voltage $C_1$ for providing a signal $H_{150}$ corresponding to a viscosity H value for 150° F. in accordance with signal $KV_{150}$ and voltage $C_1$ in the following equation:

$$H_{150}=lnln(KV_{150}+C_1),$$

where $C_1$ is a constant; $H_{210}$ signal means connected to the viscosity analyzer means and receiving voltage $C_1$ for providing signal $H_{210}$ corresponding to a viscosity H value for 210° F. in accordance with signal $KV_{210}$, voltage $C_1$ and the following equation:

$$H_{210}=lnln(KV_{210}+C_1),$$

$H_{100}$ signal means connected to the K signal means, to the $H_{150}$ signal means and the $H_{210}$ signal means for providing a signal $H_{100}$ corresponding to a viscosity H value for 100° F., in accordance with signals $H_{150}$, $H_{210}$ and $K_{150}$ and the following equation:

$$H_{100}=H_{210}+(H_{150}-H_{210})/K_{150},$$

$KV_{100}$ signal means connected to the $H_{100}$ signal means and receiving voltage $C_1$ for providing a signal $KV_{100}$ corresponding to a kinematic viscosity for the charge oil corrected to 100° F. in accordance with signal $H_{100}$, voltage $C_1$, and the following equation:

$$KV_{100}=\exp[\exp(H_{100})]-C_1,$$

and VI memory means connected to the $KV_{100}$ signal means and to the viscosity analyzer means having a plurality of signals stored therein, corresponding to different viscosity index and controlled by signals $KV_{100}$ and $KV_{210}$ to select a stored signal and providing the selected stored signal as signal VI.

6. A system as described in claim 5 in which the first ΔRI signal means also receives direct current voltages corresponding to constants $C_{28}$ through $C_{38}$ and provides the first signal ΔRI in accordance with the first ΔVI signal, signals S, $KV_{210}$, API and VI, the received voltages and the following equation:

$$\Delta RI=[C_{28}+C_{29}(KV_{210})-C_{30}(S)^2+C_{31}(\Delta VI)\cdot(API)-C_{32}(API)^2$$

$$+C_{33}(API)(KV_{210})+C_{34}(VI)^2-C_{35}(KV_{210})\cdot(VI)+C_{36}(VI)(S)$$

$$+C_{37}(\Delta VI)(KV_{210})]C_{38}.$$

7. A system as described in claim 6 in which the second ΔRI signal means also receives direct current voltages corresponding to constants $C_{60}$ through $C_{69}$ and provides the second ΔRI signal in accordance with the second ΔVI signal, signals API, S, VI and $KV_{210}$, the received voltages and the following equation:

$$\Delta RI=[C_{60}-C_{61}(\Delta VI)-C_{62}(KV_{210})^2+C_{63}\cdot(VI)^2-C_{64}(KV_{210})(API)$$

$$+C_{65}(\Delta VI)(KV_{210})+C_{66}(API)(S)-C_{67}\cdot(VI)(S)-C_{68}(\Delta VI)^2]C_{69}.$$

8. A system as described in claim 7 in which the third ΔRI signal means also receives direct current voltages corresponding to constants $C_{96}$ through $C_{102}$ and provides the third signal ΔRI in accordance with the third ΔVI signal, signals $KV_{210}$, S and API, the received voltages and the following equation:

$$\Delta RI=[-C_{96}+C_{97}(API)^2-C_{98}(S)^2+C_{99}(-\Delta VI)(KV_{210})+C_{100}(\Delta VI)(S)$$

$$+C_{101}(KV_{210})(S)]C_{102}.$$

9. A system as described in claim 8 in which the first ΔVI signal means includes $VI_{DWCO}$ signal means connected to the sulfur analyzer means, the viscosity analyzer means, to the gravity analyzer means and to the VI signal means, and receiving direct current voltages corresponding to constants $C_{17}$ through $C_{24}$ for providing a first signal $VI_{DWCO}$ corresponding to the viscosity index of the dewaxed charge oil for 0° F. in accordance with signals S, VI, $KV_{210}$ and API, the received voltages and the following equation:

$$VI_{DWCO}=-C_{17}-C_{18}(S)+C_{19}(KV_{210})^2+C_{20}(VI)^2+C_{21}(S)^2$$

$$+C_{22}(API)(KV_{210})-C_{23}(KV_{210})\cdot(VI)+C_{24}(VI)(S),$$

$VI_{DWCP}$ signal means connected to the first $VI_{DWCO}$ signal means and to the $SUS_{210}$ signal means, and receiving direct current voltages corresponding to constants $C_{25}$ through $C_{27}$ and Pour, providing a signal $VI_{DWCP}$ corresponding to the viscosity index of the dewaxed charge oil at the predetermined temperature, in accordance with signals $VI_{DWCO}$ and $SUS_{210}$, the received voltages and the following equation:

$$VI_{DWCP}=VI_{DWCO}+(\text{Pour})[C_{25}-C_{26}\cdot lnSUS_{210}+C_{27}(lnSUS)^2],$$

where Pour is the pour point of the dewaxed product; subtracting means connected to the first $VI_{DWCP}$ means and to the first and second J signal means and receiving a direct current voltage $VI_{RP}$ corresponding to the viscosity index of the refined oil at the predetermined temperature for subtracting voltage $VI_{RP}$ from signal $VI_{DWCP}$ to provide the first ΔVI signal to the first and second J signal means.

10. A system as described in claim 9 in which the second ΔVI signal means includes a second $VI_{DWCO}$ signal means connected to the gravity analyzer means, to the sulfur analyzer means, to the refractometer, and to the VI signal means, and receives direct current voltages corresponding to constants $C_{54}$ through $C_{59}$ and provides a second $VI_{DWCO}$ signal in accordance with signals RI, VI, S and API, the received voltages and the following equation:

$$VI_{DWCO}=C_{54}-C_{55}(VI)+C_{56}(S)^2-C_{57}(RI)\cdot(API)+C_{58}(API)(VI)-C_{59}(API)(S),$$

a second $VI_{DWCP}$ *signal means connected to the second* $VI_{DWCO}$ signal means and to the $SUS_{210}$ signal means and receiving the voltages corresponding to constants $C_{25}$ through $C_{27}$ and to Pour for providing a second $VI_{DWCP}$ signal in accordance with signals $SUS_{210}$ and $VI_{DWCO}$, the received voltages and the following equation:

$$VI_{DWCP}=VI_{DWCO}+(\text{Pour})[C_{25}-C_{26}lnSUS_{210}+C_{27}(lnSUS_{210})^2],$$

and second subtracting means connected to the third and fourth J signal means and to the second $VI_{DWCP}$ signal means and receiving voltage $VI_{RP}$ for subtracting signal $VI_{DWCP}$ from voltage $VI_{RP}$ to provide the second ΔVI signal to the third and fourth J signal means.

11. A system as described in claim 10 in which the third ΔVI signal means includes a third $VI_{DWCO}$ signal means connected to the viscosity analyzer means, to the gravity analyzer means, to the sulfur analyzer means, to the VI signal means and to the refractometer and receiving direct current voltages corresponding to constants $C_{90}$ through $C_{95}$ for providing a third signal $VI_{DWCO}$ in accordance with signals $KV_{210}$, VI, API, S and RI, the received voltages and the following equation:

$$VI_{DWCO}=C_{90}-C_{91}(RI)+C_{92}(API)^2-C_{93}\cdot(RI)(S)+C_{94}(KV_{210})(VI)+C_{95}(KV_{210})(S)_3$$

a third $VI_{DWCP}$ signal means connected to the third $VI_{DWCO}$ signal means and to the $SUS_{210}$ signal means, and receiving direct current voltages $C_{21}$ through $C_{23}$ and Pour, for providing a third signal $VI_{DWCP}$ in accordance with signal $VI_{DWCO}$ and $SUS_{210}$, voltages $C_{21}$ through $C_{23}$, and Pour, and the following equation:

$$VI_{DWCP}=VI_{DWCO}+(\text{Pour})[C_{25}-C_{26}/\cdot nSUS_{210}+C_{27}(lnSUS_{210})^2]$$

and third subtracting means connected to the third $VI_{DWCP}$ signal means and to the fifth and sixth J signal means and receiving direct voltage $VI_{RP}$ for subtracting the third signal $VI_{DWCP}$ from voltage $VI_{RP}$ to provide the third ΔVI signal to the fifth and sixth J signal means.

12. A control system as described in claim 11 in which the first J signal means also receives direct current voltages corresponding to constants $C_{39}$ through $C_{46}$ and provides the first J signal in accordance with signals $KV_{210}$, V, S and T, the first ΔRI and ΔVI signals, the received voltages and the following equation:

$$J=-C_{39}+C_{40}(\Delta RI)+C_{41}(S)^2-C_{42}(KV_{210})(T)+C_{43}(VI)-C_{44}(S)$$

$$+C_{45}(\Delta RI)(\Delta VI)-C_{46}(\Delta VI)(T);$$

the second J signal means also receives direct current voltages corresponding to constants $C_{47}$ through $C_{53}$ and provides the second J signal in accordance with signals S, VI, $KV_{210}$ and T, the first ΔRI and ΔVI signals, the received voltages and the following equation:

$$J=C_{47}-C_{48}(\Delta VI)-C_{49}(KV_{210})^2-C_{50}(S)(T)+C_{51}(KV_{210})(T)-C_{52}(VI)+C_{53}(\Delta RI)(\Delta VI);$$

the third J signal means also receives direct current voltages corresponding to constants $C_{70}$ through $C_{79}$ and provides the third J signal in accordance with signals S, $KV_{210}$, VI and T, the second ΔRI and the ΔVI signals, the received voltages and the following equation:

$$J=C_{70}+C_{71}(\Delta RI)-C_{72}(T)+C_{73}(T)^2+C_{74}(S)(T)+C_{75}(KV_{210})(T)$$

$$-C_{76}(VI)-C_{77}(S)-C_{78}(\Delta RI)(T)+C_{79}(\Delta RI)(\Delta VI);$$

the fourth J signal means also receives direct current voltages corresponding to constants $C_{80}$ through $C_{89}$ and provides the fourth J signal in accordance with signals VI, S, $KV_{210}$ and T, the second ΔRI and ΔVI signals, the received voltages and the following equation:

$$J=C_{80}+C_{81}(\Delta RI)+C_{82}(S)^2-C_{83}(VI)^2+C_{84}(T)^2+C_{85}(S)(T)$$

$$-C_{86}(KV_{210})(T)-C_{87}(S)-C_{88}(\Delta RI)(T)+C_{89}(\Delta RI)(\Delta VI);$$

the fifth J signal means also receives direct current voltages corresponding to constants $C_{103}$ through $C_{108}$ and provides the fifth J signal in accordance with signals S and T, the third ΔRI and ΔVI signals, the received voltages and the following equation:

$$J=-C_{103}+C_{104}(\Delta VI)+C_{105}(T)^2-C_{106}(S)+C_{107}(\Delta RI)(\Delta VI)-C_{108}(\Delta VI)(T);$$

and the sixth J signal means also receives direct current voltages corresponding to constants $C_{109}$ through $C_{117}$ and provides the sixth J signal in accordance with signals VI, S, $KV_{210}$ and T, the third ΔRI and ΔVI signals, the received voltages and the following equation:

$$J=C_{109}-C_{110}(\Delta VI)+C_{111}(S)^2-C_{112}(VI)^2-C_{113}(S)(T)+C_{114}(KV_{210})(T)$$

$$+C_{115}(KV_{210})+C_{116}(\Delta RI)(T)+C_{117}(\Delta RI)(\Delta VI).$$

13. A system as described in claim 12 in which flow rate of the charge oil is controlled and the flow of the N-methyl-2-pyrrolidone is maintained at a constant rate and the control signal means receives signal SOLV from the flow rate sensing means, the selected J signal from the selection means and a direct current voltage corresponding to a value of 100 and provides a signal C to the apparatus means corresponding to a new charge oil flow rate in accordance with the selected J signal, signal SOLV and the received voltage and the following equation:

$$C=(SOLV)(100)/J,$$

so as to cause the apparatus means to change the charge oil flow to the new flow rate.

14. A system as described in claim 12 in which the controlled flow rate is the N-methyl-2-pyrrolidone flow rate and the flow of the charge oil is maintained constant, and the control signal means is connected to the sensing means, to the selection means and receives a direct current voltage corresponding to the value of 100 for providing a signal SO corresponding to the value of 100 for providing a signal SO corresponding to a new N-methyl-2-pyrrolidone flow rate in accordance with signals CHG and the selected J signal and the received voltage, and the following equation:

$$SO=(CHG)(J)/100,$$

so as to cause the N-methyl-2-pyrrolidone flow to change to the new flow rate.

* * * * *